United States Patent [19]

Hubbard et al.

[11] 4,163,897

[45] Aug. 7, 1979

[54] AUTOMATIC COPY RECOVERY

[75] Inventors: James H. Hubbard, Boulder; Wallace L. Hubert, Broomfield, both of Colo.

[73] Assignee: International Business Machines Corporation, Armonk, N.Y.

[21] Appl. No.: 843,384

[22] Filed: Oct. 19, 1977

[51] Int. Cl.[2] ..... G06B 27/06

[52] U.S. Cl. ..... 235/92 SB; 235/92 SH; 235/92 R; 355/14

[58] Field of Search ..... 235/92 SB, 92 SH, 92 DP; 355/14; 340/259

[56] References Cited

U.S. PATENT DOCUMENTS

| | | | |
|---|---|---|---|
| 3,188,619 | 6/1965 | Hemphill et al. | 340/259 |
| 3,259,240 | 7/1966 | Schneider | 209/74 |
| 3,588,472 | 6/1971 | Glaster et al. | 235/92 |
| 3,709,485 | 1/1973 | Acquaviva | 271/57 |
| 3,778,629 | 12/1973 | Terryn | 250/557 |
| 3,944,794 | 3/1976 | Reehil et al. | 355/14 |
| 3,987,429 | 10/1976 | Manduley et al. | 235/92 SB |
| 4,026,543 | 5/1977 | Leclere | 271/259 |

*Primary Examiner*—Joseph M. Thesz

*Attorney, Agent, or Firm*—H. F. Somermeyer; C. M. Wright

[57] ABSTRACT

Copy production machine capable of having copies from plural independent copy runs in a copy sheet transport path at a given instant. Copy jam recovery is enhanced by maintaining separate counts of all individual images having copies simultaneously present in the copy sheet path. Apparatus and procedures are described for utilizing the counts for precisely recovering loss of copy sheets due to a jam or other stoppage condition. Control of a billing meter is also disclosed.

23 Claims, 30 Drawing Figures

AUTOMATIC COPY RECOVERY

DOCUMENTS INCORPORATED BY REFERENCE

U.S. Pat. No. 4,026,543 shows a jam detection and collator interconnect circuit.

Copending commonly-assigned patent application Ser. No. 651,883, filed Jan. 23, 1976, now U.S. Pat. No. 4,067,649 shows a duplex control circuit usable with the present invention.

Copending commonly-assigned patent application Ser. No. 729,451, filed Oct. 4, 1976, now U.S. Pat. No. 4,086,658 shows a programmable control usable in connection with practicing the present invention.

BACKGROUND OF THE INVENTION

The present invention relates to copy production machines and particularly to those machines capable of having multiple copy runs in a copy sheet transport path at a given instant. In particular, the invention pertains to recovery from error conditions in such a machine.

The performance of copy production machines has been continually increasing, particularly copy production machines that have the capability of simultaneously processing copies of multiple images with the result that recovery from a jam condition in a copy production machine has become quite complicated. Not only must the lost copies be recovered but they must also be identified with an image carried by the lost copies. The situation becomes more complicated when duplex copying is provided in such machines. In such situations the machine must know whether the first or second side is being produced as well as the number of good copies remaining in an interim storage unit storing the single-imaged copies.

All of these problems are compounded in rental copy production machines because the user should not pay twice for a copy produced or be able to manipulate the machine to avoid the rental charges. Recovery from jam conditions also should be set up so that the calculations are relatively simple. Furthermore, in the copy production machines of the convenience copier type, i.e., ones without a fully automatic recirculating document feed, suitable instructions have to be provided for the operator to achieve successful jam recovery. Such procedures should be simple so that a relatively untrained operator can achieve copy jam recovery. With the advent of using programmable processors in the control of copy production machines, the procedures involved should be amenable to computer program implementations.

SUMMARY OF THE INVENTION

In accordance with the invention, copy jam recovery is facilitated by separately tallying copies made of each image on copy sheets in a copy transport path and indicating the relative location of such copies within the path. Furthermore, indication of physical location of copy sheets independent of images is indicated. The two indications are combined for operating the copy production machine for facilitating copy jam recovery.

Operation of a document feed in conjunction with a copy production machine enables copy recovery based upon the operation of the original document feed. Whether in duplex or simplex operation, it is the number of images rather than the original documents that determine recovery procedures indicated by the copy recovery means of the present invention. Operation of the document feed is such that recovery is accomplished with a minimum delay.

The method of monitoring operation of a copy production machine includes indicating when copies are to be made from a given image, separately counting the number of copies being made from such given image and repeating the above two steps for each image being produced when more than one copy is to be made of each such image. Furthermore, the separate image counts are arranged in order to indicate the relative position of the copy sheets of each image within a copy transport path. The counts are decremented as copy sheets leave the copy production machine for maintaining a transient count of all copy sheets and the respective images within the copy sheet transport path. When any one of the individual counts go to zero, a copy run completion is indicated.

In recovery from a copy jam, the total of the counts indicates the total number of copies to be remade, and the number of individual counts signifies the number of images to be recopied. The number of images to be recopied is suitably illuminated on the operator's control panel for a convenience copier operation and suitably supplied to an automatic document feed for ensuring that the previously copied images are actually recopied in the recovery process.

The foregoing and other objects, features, and advantages of the invention will be apparent from the following more particular description of preferred embodiments of the invention as illustrated in the accompanying drawings.

THE DRAWINGS

DETAILED DESCRIPTION

Figure 1:
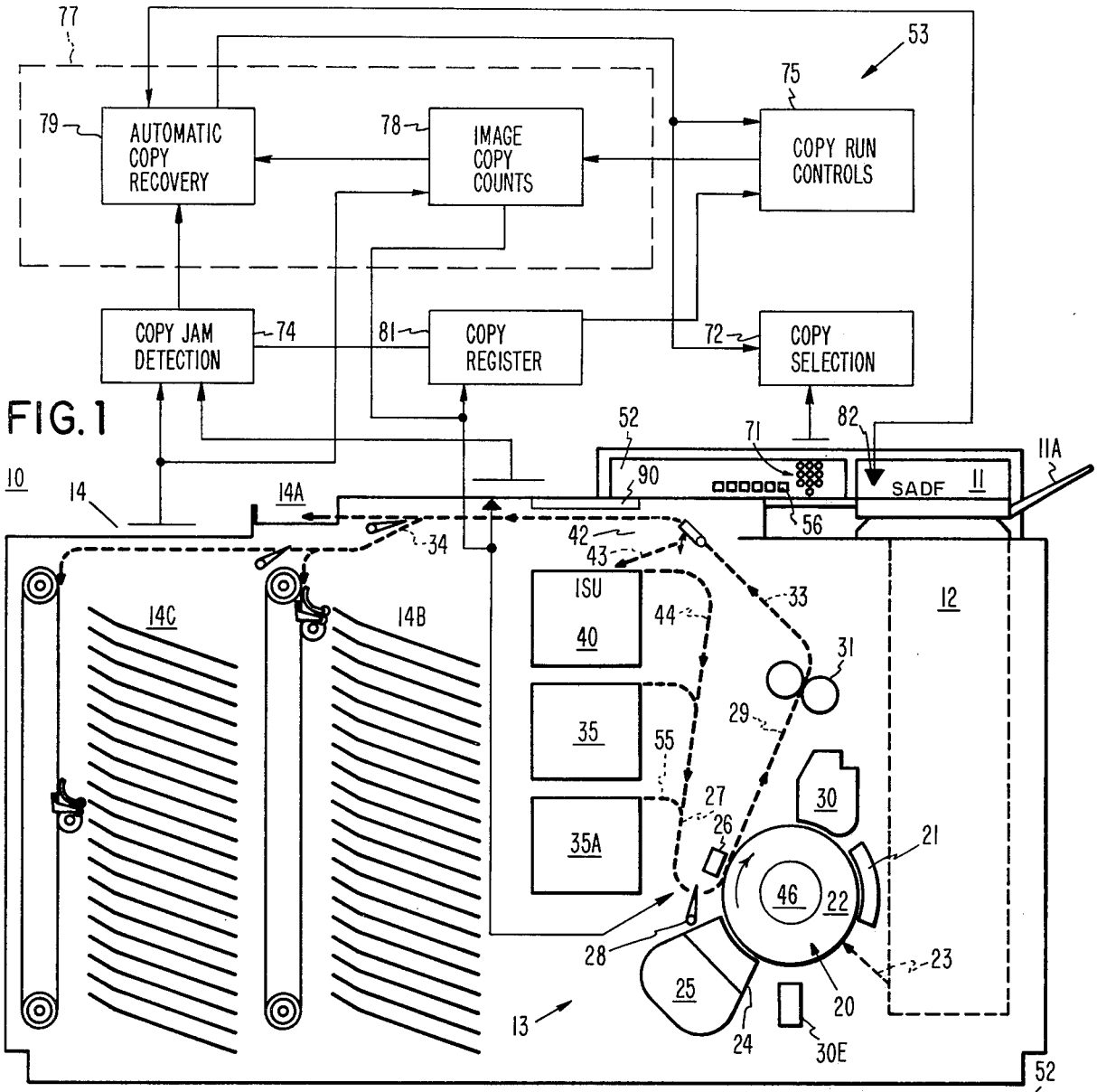
FIG. 1 is a diagrammatic showing of a convenience copier type of copy production machine incorporating the teachings of the present invention.

In the drawings, like numerals and characters indicate like parts and structural features in the various diagrams. A copy production machine 10 (FIG. 1) has an original document semiautomatic document feed (SADF) 11 for receiving manually inserted originals to be copied. Originals may be placed in an input tray 11A and automatically fed to a transparent platen (not shown) to be scanned by original optics 12 for imposing an optical image on photoconductor drum 20 of copy production portion (CPP) 13. Alternatively, SADF 11 may be ignored by lifting a portion thereof and directly placing the original on the platen. The latter operation is termed manual operation, and the former is termed semiautomatic operation. Recovery according to the present invention is operable with multiple modes of original document inputs including fully automatic document feeding (not shown). Copies produced by CPP 13 are supplied automatically to output portion 14. Portion 14 includes an exit tray 14A for receiving noncollated copies or precollated copies, and two collator sections 14B and 14C for collating produced copies as is well known in the arts.

Figure 2:
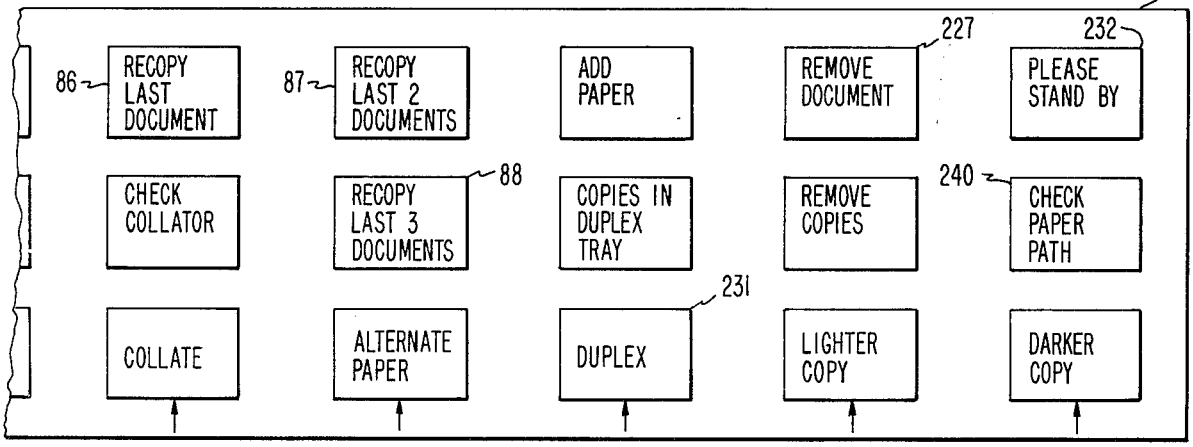
FIG. 2 is a diagrammatic showing of a portion of the operator's control panel for the machine shown in FIG. 1.

Machine 10 includes an operator's control panel 52 wherein the operator inserts production parameters to an automatic control 53 for operating the copy production machine 10. To achieve this input, a plurality of switches and a keyboard are provided, as will be later more fully described. Furthermore, a series of indicator lights are in operator's control panel 52 for providing machine-to-operator communications. A portion of the machine-to-operator communication is shown in FIG. 2 Those indicators pertaining to automatic copy recovery and the operator interaction with the automatic circuits of the present invention will be detailed later.

Before proceeding further with the description of the invention, the operation of copy production portion (CPP) 13 is described as a constructed embodiment of a so-called xerographic copy production machine 10. Photoconductor drum member 20 rotates in the direction of the arrow past a plurality of xerographic processing stations. The first station 21 imposes either a positive or negative electrostatic charge on the surface of photoconductor member 20. It is preferred that this charge be a uniform electrostatic charge over a uniform photoconductor surface. Such charging is done in the absence of light such that projected optical images, indicated by dash line arrow 23, alter the electrostatic charge on the photoconductor member in preparation for image developing and transferring. The projected optical image from original input optics 12 exposes the photoconductor surface in area 22. Light in the projected image electrically discharges the surface areas of photoconductor member 20 in proportion to light intensity. With minimal light reflected from the dark or printed areas of an original document, for example, there is no corresponding electrical discharge. As a result, an electrostatic charge remains in those areas of the photoconductive surface of member 20 corresponding to the dark or printed areas of an original document in SADF 11 (semiautomatic document feed). This charge pattern is termed a "latent" image on the photoconductor surface. Interimage erase lamp 30E discharges photoconductor member 20 outside defined image areas.

The next xerographic station is developer 24 which receives toner (ink) from toner supply 25 for being deposited and retained on the photoconductive surface still having an electrical charge. The developer station receives the toner with an electrostatic charge of a polarity opposite that of the charged areas of the photoconductive surface. Accordingly, the toner particles adhere electrostatically to the charged areas but do not adhere to the discharged areas. Hence, the photoconductive surface, after leaving station 24, has a toned image corresponding to the dark and light areas of an original document in SADF 11.

Next, the latent image is transferred to a copy sheet (not shown) in transfer station 26. The copy sheet is brought to the station 26 from an input copy sheet path portion 27 via synchronizing input gate 28. At station 26, the copy sheet (not shown) is brought into contact with the toned image on the photoconductive surface resulting in a transfer of the toner to the copy sheet. After such transfer, the image bearing copy sheet is stripped from the photoconductive surface for transport along path 29. Next, the copy sheet has the electrostatically carried image fused thereon in fusing station 31 for creating a permanent image on the copy sheet.

After the image area on member 20 leaves transfer station 26, there is a certain amount of residual toner on the photoconductive surface. Accordingly, cleaner station 30 has a rotating cleaning brush (not shown) to remove the residual toner for cleaning the image area in preparation for receiving the next image projected by original input optics 12. The cycle then repeats by charging the just-cleaned image area at charging station 21.

The production of simplex copies or the first side of duplexing copies by portion 13 includes transferring a blank sheet of paper from blank paper supply 35 to transfer station 26, fuser 31, and, when in the simplex mode, directly to the output copy portion 14.

When in the duplex mode, duplex diversion vane or gate 42 is actuated by control 53 to the actuated position for deflecting single-image copies to travel to the interim storage unit 40. Here, the partially produced duplex copies (image on one side only) are stored for the next single-image copy producing run in which the stored copy sheets receive the second image.

In the next single-image run, initiated by inserting a document into SADF 11, the stored copy sheets are removed one at a time from the interim storage unit 40, transported over path 44 to input path 27 of receiving a second image as previously described. The two-image duplex copies are then transferred output copy portion 14.

CPP 13 also has second or alternate copy sheet supply 35A which supplies copy sheets to input path 27 via path 55. Selection of supply 35 or 35A as a copy sheet source is controlled from panel 52 by actuation of switch 56. Selection is mutually exclusive. Control circuits 53 respond to switch 56 to actuate a copy sheet picker (not shown) in the respective copy sheet supplies 35 or 35A in a usual manner.

Control 53 includes a copy selection register 72 responsive to keyboard 71 to register the number of copies desired to be produced of a given image during a given run. When multiple successive runs occur in machine 10, the numerical contents of copy selection register 72 can apply to a plurality of such runs. The location of each copy sheet in the copy path, independent from images carried by such copy sheets, beginning with input path 27 and extending through paths 29, 33, 34 and into the collators 14B or 14C is indicated by copy register 81. Register 81 can be a shift register having a binary one indication for each sheet in the path and being shifted synchronously with the copy sheet transport.

Register 81 can alternatively be a straight binary counter wherein the numerical count indicates the number of copy sheets in the paths 27, 29, 33 and 34. In any event, register 81 signifies the number of copy sheets currently in the copy paths.

A copy jam detector 74 has a plurality of copy sheet sensing switches (not shown) distributed along the copy paths. Copy jam detection 74 responds to copy register 81 and to signals from the emitter wheel 46 to detect jams, such as set forth in LeClere U.S. Pat. No. 4,026,543.

Copy run controls 75 respond to copy selection 72 and copy register 81 to operate machine 10, particularly CPP 13, during each copy run. The copy recovery portion 77 of controls 53 includes a register 78 indicating the number of images currently on copies in the copy paths. Automatic copy recovery portion 79 cooperates with the image count register 78, copy jam detection 74, and original document exit switch 82 of SADF 11 to indicate to copy run control 75 and copy selection register 72 the number of images to be recopied. This is achieved by subtracting the number of copy sheets lost from the number of copies to be produced from copy sheets picked from one of the copy sheet sources 40, 35 or 35A. Furthermore, in a multiple image situation automatic copy recovery 79 illuminates one of three indicators on control panel 52 (FIG. 2). If only the last document is to be recopied, then indicator 86 is illuminated. If two images were lost in the copy jam, than indicator 87 tells the operator to recopy the last two documents. Indicator 88 tells the operator to recopy the last three documents. In this regard, copy production machine 10 has an original document exit tray 90 (FIG. 1). In recopying more than one document, the operator must first copy the bottommost document of the number of documents indicated by indicators 87, 88. The operator then returns the documents to be recopied to input tray 11A for recopying via operation of SADF 11.

Figure 3:
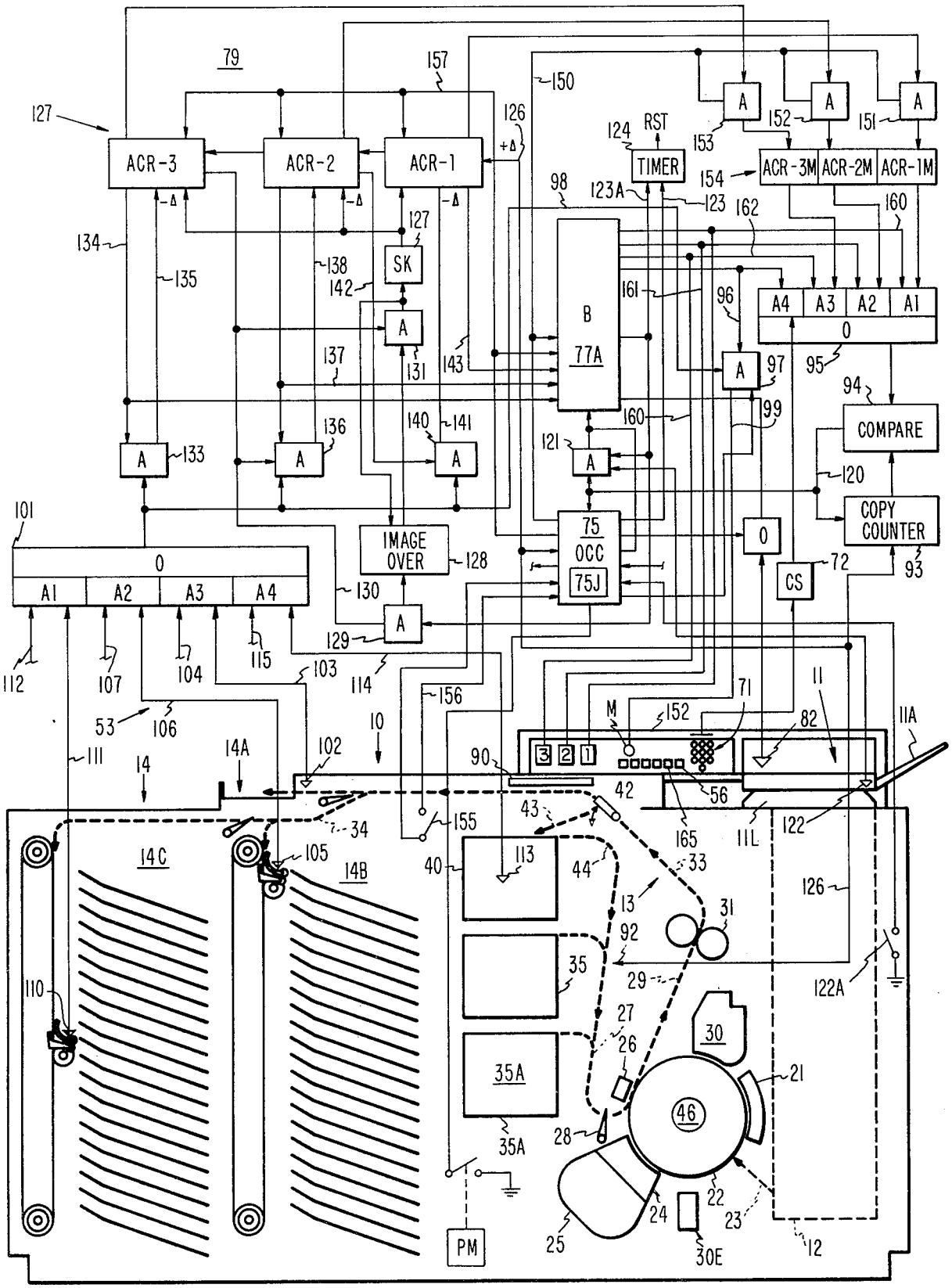
FIG. 3 is a combined logic and diagrammatic showing of a control for effecting copy recovery utilizing the present invention with the FIG. 1 illustrated copy production machine.

The ensuing following description of FIG. 3 assumes that copy production machine 10 has been initialized and is ready for copy production. The number of copies to be made of an image contained on an original in SADF 11 is contained in copy selection register CS 72. As CPP 13 proceeds with copy production, blank copy sheets from supply 35 are sensed by switch 92, which in a constructed embodiment was in the proximity of input aligner 28, for incrementing copy counter 93. Copy counter 93 therefore represents the number of blank copy sheets fetched by CPP 13 for the production of copies. When the count in counter 93 is equal to the numerical contents of copy select register 72, no more copy sheets are that have been and are being picked for that particular run and the original document in SADF 11 can be ejected. Compare circuit 94 signals equality between copy counter 93 and the numerical contents of copy select register 72. In this regard, the signal contents of copy select register 72 travels through the A4 input portions (AND circuits) of AO's 95 to reach compare 94. The A4 input portions are actuated by copy recovery circuits 77 indicating that the operation being performed in copy production machine 10 is not an automatic copy recovery (ACR) operation. Such NOACR signal on line 96 also travels to AND circuit 97. AND circuit 97, being inter alia by the NOACR signals, actuates the billing meter M of copy production machine 10 when a completed copy has reached output porton 14. Such completed copy is signified by a signal, later described, received over line 98 while other copier controls or copy run controls 75 are simultaneously signifying to AND circuit 97 that no auxiliary operation is being performed, such as indicated by the signal received over line 99. Examples of auxiliary operations include the automatic emptying of interim storage unit 40 upon the change of mode between duplex and simplex copy production as set forth in Ser. No. 651,883, supra.

The billing meter M is actuated when a completed copy leaves a so-called "billing exit." AO circuit 101 supplies the completed copy signal as a potential billing signal on line 98 based upon one of three output portion 14 sensing switches. In the noncollate mode, exit tray 14A switch 102 sends a copies completed signal over line 103 to the A3 input portion of AO 101 for generating the billing copy signal on line 98. The other inputs to A3 input portion received over line 104 are from OCC 75 representing a noncollate mode of copy production. Similarly, output or vane switch 105 in collator 14B supplies a copy completed signal over line 106 to the A2 input portion which is enabled by a signal from OCC 75 received over line 107. The A2 input portion is enabled by OCC 75 in the copy production machine collate mode when the number of copies being produced is from one to twenty. For collated copies from 21 through 40, the switch 110 in collator 14C supplies its copy completed signal over line 111 to the A1 input portion which in turn is enabled by OCC 75 by appropriate signals received over line 112.

The A4 input portion of AO 101 is also used in connection with ISU 40. When the copy production machine 10 is in the duplex mode and side one is being produced, switchable vane 42 directs the single-imaged, partially completed duplex copies to path 43 for entering ISU 40. Switch 113 senses such entries and supplies a copy received signal over line 114 to A4 input portion of AO 101. OCC 75 during such an operation supplies a suitable enabling signal over line 115 for enabling AO 101 to supply a copy-received signal over line 98. It will be remembered that line 98 can actuate AND circuit 97 for incrementing billing meter M. Since the supply of partially completed copies to ISU 40 is an intermediate operation which is in the same billing category as auxiliary operations, the signal on line 99 blocks AND circuit 97 whenever A4 input portion or AO 101 is enabled by the signal on line 115. In the alternative, of course, the copies supplied through ISU 40 can be billed directly as fully completed copies, i.e., the charge being for images copied, not copy sheets.

When compare 94 detects a coincidence between copy counter 93 and copy select register 72, it supplies an "end run" signal over line 120 resetting copy counter 93 and signifies to OCC 75 that the end of the run is imminent. AND circuit 121 responds to the end run signal to sense the preentry switch 122 of SADF 11 for initiating a new run via OCC 75 and indicating to recovery circuit 77, particularly image copy count register 78, that a new image is being copied by copy production machine 10. Line 120 also goes to copy recovery circuit 77 (shown as circuit B 77A in FIG. 3) for decrementing the transient image copy count in register 78.

The end run signal on line 120 actuates circuit 77A also to supply an activating signal over line 123A to complete the enablement of AND circuit 121 to initiate a copy production run based on actuation of preentry switch 122. The signal on line 123A also actuates a thirty second timer 124 which, when it times out, resets all of the copy production parameters of copy production machine 10 to a dominant mode of copy production, i.e., in a convenience copier, this is usually a simplex mode of copy production, normal original, and a noncollate mode for making one copy. As soon as AND circuit 121 has initiated a new copy production run, timer 124 is reset by a changing signal on line 123 as is well known.

Each time input copy sheet switch 92 of CPP 13 senses a successfully picked copy sheet from either ISU 40 or supplies 35 or 35A, it supplies a new copy sheet picked signal over line 126 to OCC 75 and to the automatic copy recovery registers (ACR) 127 of automatic copy recovery circuit 79. ACR 127 is divided into three registers, ACR-1, ACR-2 and ACR-3. The three registers are selected because the copy sheet paths 27, 29, 33, 34 have a capability of having multiple copy image runs with three different images at a given instant. If the copy paths hve a capacity for containing four mode copy runs at a given instant, then four ACR registers would be provided. Any ACR register being nonzero signifies that a given image is in one of the copy paths. Assume that the ACR registers 127 are all zero. Upon initiation of a copy production run, switch 92 senses a first copy sheet was picked. ACR-1 then is incremented to unity. Each successive copy sheet picked for that given run results in ACR-1 being incremented. Therefore, up to this point the copy counter 93 and ACR-1 will contain the same numerical values.

Compare signal on line 120 signifying end run causes the numerical contents of ACR-1 to be shifted to ACR-2, ACR-2 to be shifted to ACR-3. If, at this time, ACR-3 is nonzero, too many copy sheets are in the path and a jam is signified. Such end-run shifting of the numbers stored in the shift registers is controlled by shifting circuit SK 127. SK 127 in turn is actuated by the image-over latch 128. At the end of a run as detected by compare 94, circuit 77A supplies an end signal over line 123A, as previously described. The end signal on line 123 also travels to AND circuit 129 for setting image-over latch 128. Image-over latch 128 may be set to the active condition when ACR-3 is all zeros as indicated by the signal on line 130. The active condition of the image-over latch 128 is sent to AND circuit 131 for actuating SK 127 when the line 130 signal indicates ACR-3 equals zero. The output signal from AND 131 also resets the image-over latch 128. Additionally, the line 130 signal and the line 123A end signal are supplied to jam detection circuits 75J in OCC 75 for detecting too many copy sheets in the copy paths. As the next copy run starts, ACR-2 has a value indicating copies being made of a previous run while ACR-1 will be incremented with copy counter 93. From this description it is clear how ACR's are incremented.

The ACR registers 127 are decremented by the output signal of AO 101. As previously described, AO 101 supplies a signal each time a completed or partially completed copy has been sent to its intended destination. Decrementing the ACR registers 127 is based upon the signal content of such registers. The highest numbered nonzero register, denominated ACR-X, is always decremented. For example, if ACR-3 is nonzero, then it is decremented. If ACR-3 is zero then ACR-2 is decremented if it is nonzero. If both ACR-2 and ACR-3 are zero, then ACR-1 is decremented. It also may be interesting to note that the highest numbered nonzero ACR register denotes the furthest progress of the copy sheets and its respective image in the copy paths.

ACR-3 is decremented by AND circuit 133 which is enabled by the signal on line 134 indicating ACR-3 is nonzero. The line 98 signal passes through AND 133 to line 135 to decrement ACR-3. In a similar manner, AND circuit 136 passes the line 98 signal to line 138 for decrementing ACR-2 when the line 130 signal indicates ACR-3 is equal to zero and the line 137 signal indicates ACR-2 is nonzero. Similarly, AND circuit 140 decrements ACR-1 via line 141 when ACR-2 signifies it is zero by supplying an active signal over line 142. The line 130 could be connected to AND 140 but is not necessary since ACR-2 will never go to zero unless ACR-3 is already zero. The ACR-1 nonzero signal supplied over line 143 travels to circuit 77A for aiding in error recovery. Accordingly, the ACR registers 127 contain counts which represent the number of copies of each respective image in the copy paths with the nonzero registers indicating relative locations of the images in the copy sheet paths.

Assume that a jam is detected either as above described in accordance with U.S. Pat. No. 4,026,543 or otherwise. OCC 75, which contains the jam detection circuit 75J, will supply a jam detected signal over line 150 to circuit 77A and to three sets of AND circuits 151, 152 and 153. Such AND circuits respond to the line 150 jam detected signal to transfer the signal contents of the ACR registers 127 to the ACR-M registers 154, respectively. Signal contents of the ACR-M or memory registers 154 are used in connection with reproducing copies lost in the jam.

The detection of the jam stops the production of copies in copy production machine 10. Copies, therefore, which are partially completed still reside in the copy paths as aforedescribed. The operator then opens the door to the copy production machine and removes the copies. Such removal may require the operator to move portions of the copy path transport apparatus. Such apparatus is returned to its normal copy transporting position. Upon completion of the physical recovery portion, the operator actuates misfeed reset switch 155 signifying to copy production machine 10 that the operator has completed the physical portion of the jam recovery. Switch 155 sends its signal over line 156 to OCC 75 which then will reinitiate copy production in the recovery mode. OCC 75 retransmits the line 156 signal over line 157 to circuit 77A signifying to circuit 77A that copy recovery is underway. Circuit 77A will have remembered that at the time of the jam indicated by the signal on line 150 which of the ACR registers 127 were nonzero. This memory is in a set of three latches (not shown), one for each of the ACR registers. The line 157 signal also goes to the ACR registers 127 for clearing same to zero. Simultaneously, the circuits 77A three latches, remembering which of the ACR registers 127 were nonzero, supply a recopy indicator actuating signal over one of the lines 160, 161, 162. If all three latches (not shown) are set to the active condition, then indicator 88 is actuated telling the operator to recopy the last three documents. The operator then takes the third document from the top in original exit tray 90 and places same in SADF tray 11A. Switch 122 senses the reentered documents and actuation of switch 122A by the operator initiates copy production as aforedescribed. The number of copies to be made is not now determined by copy select register 72 but by ACR-3M register which supplies its numerical content indicating signals to the A3 input portion of AO 95. The A3 input portion is actuated to pass the signal contents of ACR-3M by the line 160 signal which also actuates indicator 88. Accordingly, the number of copies made will be those necessary to recover the copies lost by the image closest to an exit or most progressed in the copy path.

Similarly, ACR-2M contains the secondmost progressed image copy count and supplies its numerical contents to the A2 input portion of AO 95. In one embodiment, the line 161 signal was actuated by circuits 77A upon completion of the recopying of the ACR-3M signal telling the operator to recopy the second to the last document. In the alternative, indicator 88 may be illuminated only once for recopying all three documents. In any event the A2 input portion is actuated for recopying the copies lost with respect to the second image in the copy paths. Similarly, ACR-1M supplies its signals to the A1 input portion for recopying the last copy sheets lost from the last image inserted into copy production machine 10. When the compare circuit 94 supplies its end run signal on line 120 to circuits 77A all three of the latches signifying ACR are reset, reenabling the line 96 signal which had been disabled by the ACR operation. Circuit 77A then extinguishes the appropriate indicator 86, 87, 88 signifying to the operator that normal copy production can now resume.

The above-described procedures also apply for manual operation of the copy production machine. For example, SADF 11 may have its lid raised for manual operation. In such an instance preentry switch 122 will not function to start a copy production run. Rather a start switch 165 is actuated by the operator after placing an original document to be copied on the platen of SADF 11. Since start switch 165 and preentry switch 122 both actuate OCC 75 in the identical manner, except for control of SADF 11, all of the above-described procedures apply to manual operation as well as semiautomatic operations. Furthermore, if a fully automatic document feed replaced or supplemented SADF 11, then the controls comparable to preentry switch 122 in such an automatic document feed will easily enable operation of the copy recovery with such a document feed.

Figure 4:
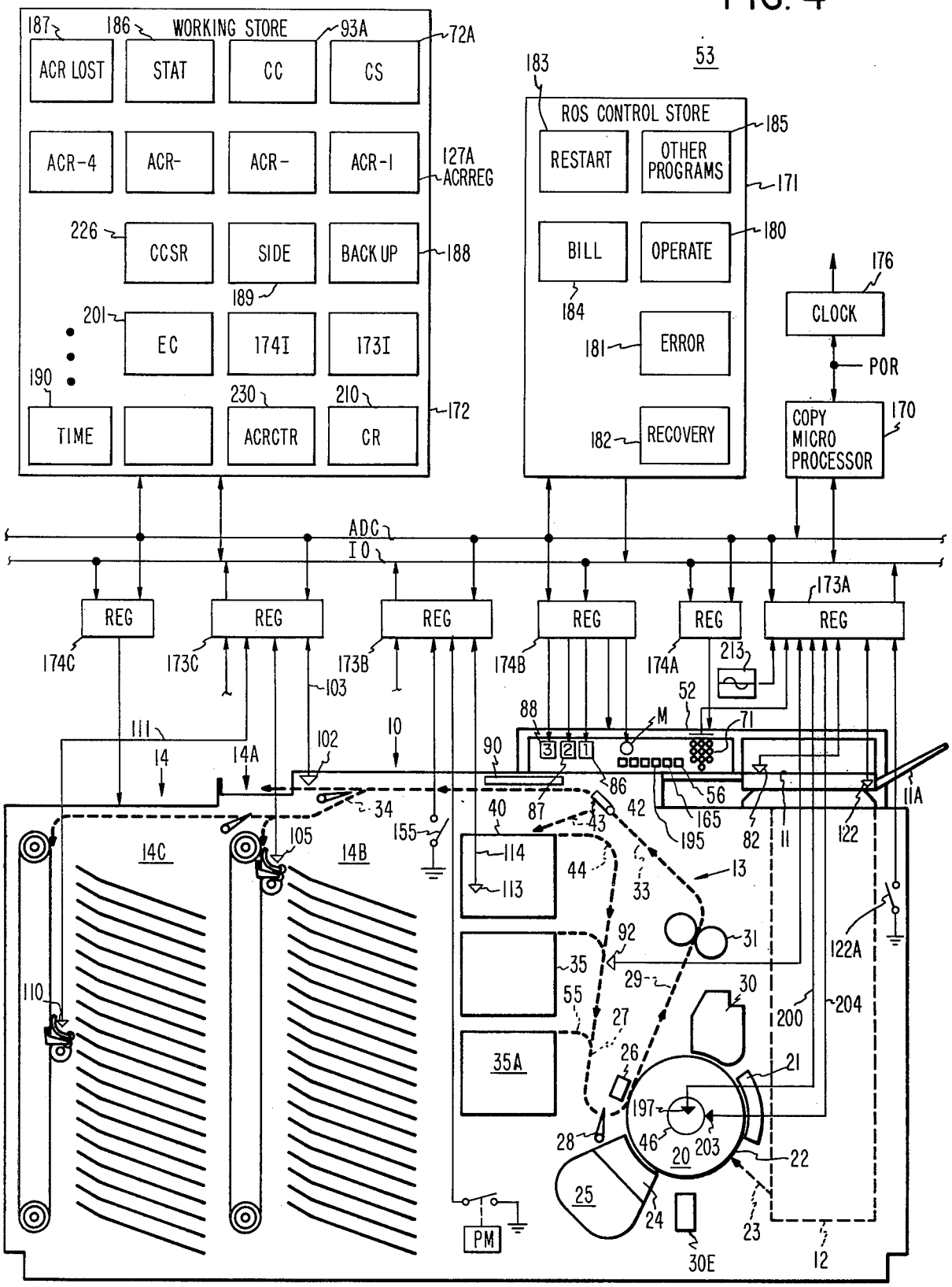
FIG. 4 is a combined logic and diagrammatic showing of a computerized version of the invention for implementing copy recovery in the FIG. 1 illustrated machine.

A preferred form of practicing the invention is shown in FIG. 4 where, rather than employing electronic circuits, a programmable copy microprocessor 170 responds to programs resident in ROS control store 171 to perform all the functions above stated with respect to FIG. 3. Furthermore, a working store 172 has program designated registers therein for achieving all of the memory requirements set forth with respect to FIG. 3 and incident to automatic copy recovery. Copy microprocessor 170 is preferably the microprocessor set forth in the copending commonly-assigned patent application Ser. No. 729,451 (now U.S. Pat. No. 4,086,658). It is to be understood that any microprocessor or computer may be used for practicing the present invention in its preferred mode. The choice of the computer is incidental to the successful practice of the invention. It is well known that any program functions can be programmed on any computer. This is shown in the book MICROPROGRAMMING PRINCIPLES AND PRACTICES by Samier S. Husson, Prentice Hall Inc., Englewood Cliffs, N.J., copyright 1970, Library of Congress catalog card number 72-122612. Other text and a plethora of literature articles, particularly in the proceedings of the Institute of Electrical and Electronic Engineers, will show that any one of ordinary skill can employ the flow charts hereinafter and the description here and above for implementing the present invention in any copy production machine using any computerized approach.

Copy microprocessor 170 controls the copy production machine 10 as well as operates the working store 172 and ROS control store 171. An address bus ADC receives address signals from copy microprocessor 170 for addressing the ROS control store 171, working store 172, and the designated input/output registers 173, 174. Data communication between the various elements of the computerized programmable control is via a bidirectional data bus IO which is preferably one byte wide. The input registers 173 supply unidirectional signals to IO for receipt by copy microprocessor 170 which are then retransmitted to working store 172 under program control. Similarly, output signals are unidirectionally supplied to the output registers 174 for retransmission to copy production machine 10. In a preferred form, the output registers 174 are latches which supply static signals as indicated by the various connections to copy production machine 10 for controlling its various components and elements using well known process control techniques. Similarly, various switches and sensing points are supplied to the input registers 173 in accordance with well established process control principles and practices.

ROS control store 171 contains a plurality of sets of programs which the copy microprocessor 170 responds to not only for operating copy production machine 10 but also for implementing automatic copy recovery. Usual operation of the copy production machine 10 is via the operate programs 180. Jam detection and other error detection are performed by copy microprocessor 170 responding to the error programs 181. The recovery unit 79 is emulated by copy microprocessor 170 responding to the recovery programs 182. Restart after recovery is effected via programs 183 while the billing control during recovery and during normal operation is achieved by the program 184. Other programs 185 resident in ROS control store 171 are used for performing auxiliary functions, maintenance functions and other functions not pertinent to the practice of the present invention.

Registers in working store 172 include the ACR registers 127A, copy select register 72A, copy count register 93A, a status register 186, an ACR lost register 187 which stores the number of images lost to be recovered in the duplex mode. Furthermore, a backup register 188 is used to illuminate indicators 86, 87, 88, a side register 189 indicating side one or side two in duplex mode, images of input/output registers 173, 174 as indicated by 173I and 174I and a time register 190 corresponding to timer 124. The single ACR lost register 187 replaces ACR-M registers 154. Other specially denominated registers in working store 172 are indicated by the unnumbered rectangles and ellipses.

The operation of control 53 in its computerized form is timed by clock 176 which provides timing signals in the usual manner to all elements. It must be remembered that the copy microprocessor 170 and its associated control 53 components operate at electronic speeds which are much faster than the speeds of copy production machine 10. Also, before the computerized control 53 can operate copy production machine 10, it must be first initialized to a startup state which is indicated by the POR line (power on reset) which initializes copy microprocessor 170 to operate from ROS control store 171 as any computer is initialized in any process control system.

Figure 5:
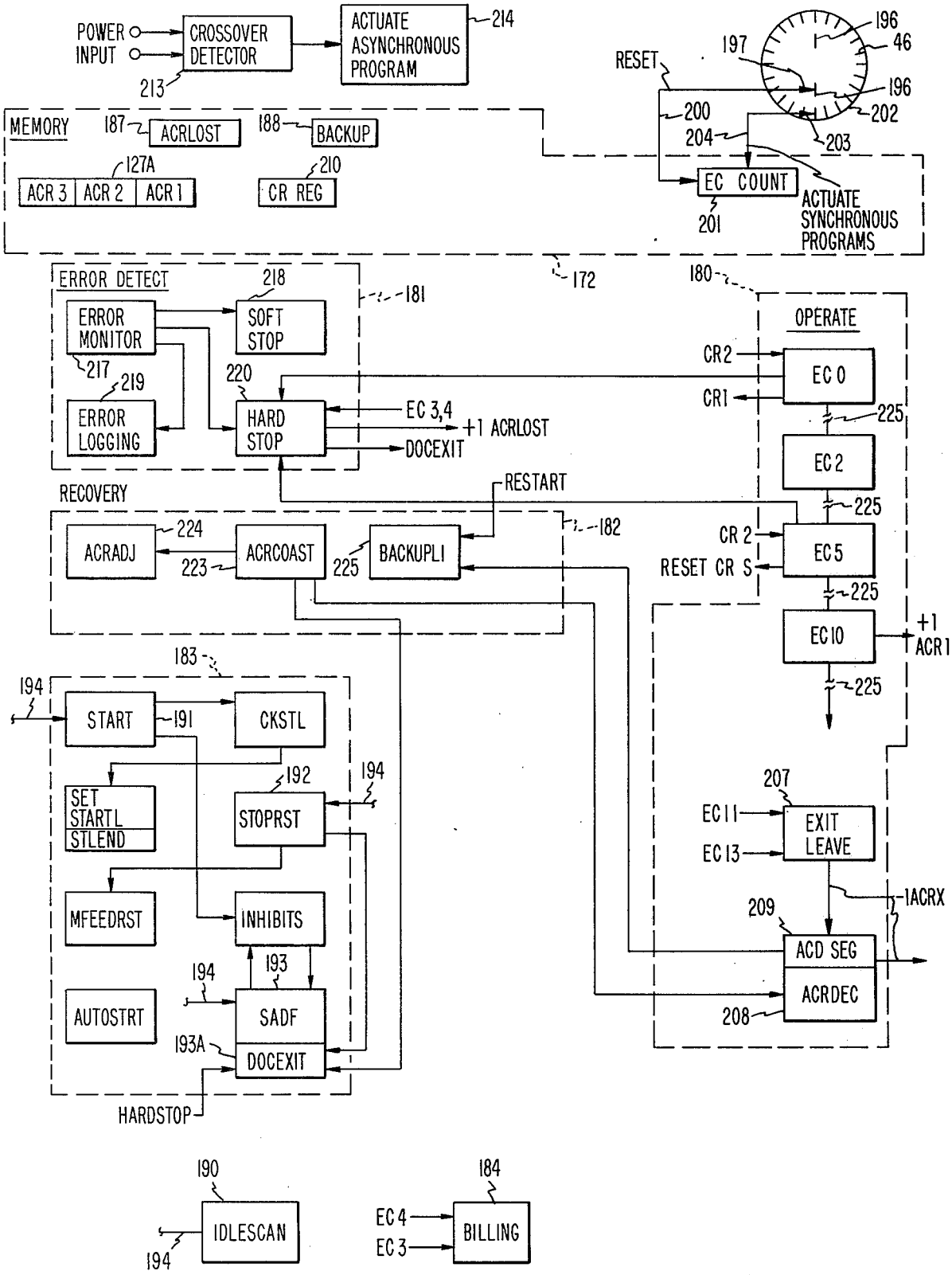
FIG. 5 is a diagrammatic showing of procedures for implementing the present invention and usable in connection with the FIG. 4 machine illustrated in FIG. 4.

The interactive response of copy microprocessor 170 with the stored programs in ROS control store 171 is set forth in FIG. 5 and arranged as shown in FIG. 4 ROS control store 171. The description of FIG. 5 assumes that the POR operation has been completed. The machine is now waiting for action to occur. A small main or idlescan program 190 invokes predetermined programs within ROS control store 171 for repeatedly sensing for any operator input. As shown in FIG. 5, the idlescan 190 actuates copy microprocessor 170 to execute the start program 191, stop reset program 192, the SADF program 193, all as indicated by the truncated lines 194. Start program 191 senses start switch 165 for detecting whether or not a manually-actuated copy production run is to be performed, i.e., the operator has placed an original document on the platen (not shown) of SADF 11. Similarly, the SADF program 193, when invoked by idlescan 190, senses preentry switch 122 and switch 122A via input register 173A for determining whether or not a copy production request is being made by an original document in the preentry position on SADF tray 11A. Stop reset 192 senses for actuation of the stop button 195 which is used by the operator to stop all copy production as well as nullifying the effect of the actuation of the start button 165.

Once the copy production machine 10 is started two groups of computer programs are used by copy microprocessor 170 to control copy production machine 10. The first is a set of machine 10 synchronous programs timed by emitter wheel 46. Emitter wheel 46 has two fiducial or synchronization marks 196 which are suitably sensed by sensor 197. The term marks means magnetic or optically sensible marks. Sensor 197 sends its signal over line 200 to an input register 173A (FIG. 4). Copy microprocessor 170 responds to this signal as an interrupt signal to clear a register 201 in working store 172 which contains a so-called EC, or emitter count. Additionally, emitter wheel 46 has a plurality of emitter marks collectively designated 202, which are sensed by sensor 203 to supply emitter pulses over line 204 to input register 173A and also act as interrupt signals. Copy microprocessor 170 responds to the line 204 signal to increment the count in register 201. Such interrupt and counting are well known and are not further described for that reason. The count in register 201 signifies the progression of copy production in CPP 13 during each image transfer or copy production cycle. The copy microprocessor 170 responds to the interrupt on line 204 and to the count in register 201 to invoke one of a plurality of synchronously operated programs for operating CPP 13. These programs are designated EC0 through EC16 and constitute the major portion of the operate programs 180. Not all of the synchronous programs are pertinent to automatic copy recovery and therefore are not further described. Programs of interest are EC0, EC2, EC5 and EC10. In addition, these synchronous programs synchronously invoke other programs of interest to ACR which include the exit leave program 207. The copy microprocessor 170 responds to exit leave 207 to check the position of completed copies leaving the copy paths aforedescribed, the program therefore corresponding in function to AO circuit 101 of FIG. 3. Furthermore, exit leave program 207 calls the ACRDEC program 208 which decrements the ACR register 127A in working store 172. This program corresponds in function to AND circuits 133, 136 and 140 in FIG. 3. ACRDEC 208 includes an ACDSEG program 209 as will become more apparent. Incrementing the ACR register 127A is achieved through the EC10 program, i.e., indicates that a copy sheet has been picked by CPP 13 as sensed by switch 92 and signalled to an input register 173A (FIG. 4). The physical status of the copy sheets in the illustrated copy paths is indicated by a bit pattern in CR register 210 as will be further described.

Many of the other programs in ROS control store 171 need not be executed by copy microprocessor 170 in a manner synchronous with rotation of photoconductor drum 20. These are termed asynchronous programs. In this regard, the power input that operates copy production machine 10 is sensed by a zero crossover detector 213 which detects the zero crossovers of the AC power signal. Its output signal is supplied to register 173A as an interrupt and causes copy microprocessor 170 to scan certain asynchronous programs indicated by numeral 214. These programs include the error programs 181, recovery programs 182, and the startup programs 183. The sequence of execution of these asynchronous programs is not pertinent to the practice of the present invention and is not described for that reason. Furthermore, such asynchronous programs will include programs with respect to the collators 14B, 14C. In this regard, the ACRDEC program 208 works closely with the operate programs 180 but is also used asynchronously via the recovery programs 182 as will become apparent.

The error detect programs 181 include error monitor programs 217, a soft stop program 218, error logging programs 219, and a hard stop program 220. For purposes of illustration, the hard stop program 220 is shown in detail with respect to automatic copy recovery, it being understood that soft stop program 218 is implemented in a similar manner and is used in connection with automatic copy recovery for certain error conditions. For example, if there is a jam condition in paper path 227 a soft stop is instituted in that the copies being produced and currently in paths 29, 33, 34 may not be affected. Therefore, they can be transmitted to their intended destination without additional loss of imaged copies. Error logging 219 is useful for diagnostic and analysis purposes beyond the scope of the present description.

Recovery programs are instituted when the photoconductor drum 20 has coasted to a stop. This is determined by a timing procedure in a computer program (not shown nor described). Crossover detector 213 supplies its signal for actuating the asynchronous programs and causes ACRCOAST program 223 to be executed by copy microprocessor 170. It in turn calls the ACRADJ program 224 for making the adjustments facilitating copy recovery. ACRCOAST 223 in turn calls ACRDEC 208 for completing the recovery operations. ACRDEC then calls program BACKUPLI which illuminates the appropriate indicator 86, 87, 88 via an output register 174B.

During the copy recovery operation which requires operator interaction, as described with respect to FIG. 3 including repositioning the original documents or actuating the start button 165, billing is inhibited as will be described with respect to the billing procedure 184.

The detailed description of the copy production machine 10 functions controlled by copy microprocessor 170 responding to the various programs in ROS control store 171 is described beginning with an assumption that copies are being produced in a normal manner. Accordingly, operate programs 180 are first described. Then the monitoring of the operations of copy production machine 10 by copy microprocessor 170 via programs 181 is described, i.e., the first of the several asynchronous programs which have an important relationship to ACR. Then the machine 10 is presumed to stop. The timer (not shown) times out and crossover detector 213 then invokes the recovery operations by copy microprocessor 171. The ACRCOAST and its associated program and functions performed in copy production machine 10 are then described. Upon completion of the recovery operation, copy production machine 10 can be restarted which is described with respect to start programs 183. Finally, the inhibition of billing is described during the recopy function.

It is to be appreciated that the scope of illustration of the operate programs 180 is greatly reduced for pointing out the functions of copy microprocessor 170 with respect to ACR. Much of the code procedure is deleted for the purposes of brevity and clarity, such omissions being indicated by the microcode deletion indicators 225 throughout the FIGS. 5–28. The copy register CR 210 has eight bits for indicating the status of copy sheets within the paths 29, et seq. Additional machine state indicators may be employed for assisting copy microprocessor 170 in controlling copy production machine 10. The bits of CR 210 are numbered 1–8. CR1, when a binary one, indicates that a copy sheet is to be picked from either ISU 40 or supplies 35 or 35A. CR2 being a one generally indicates a copy sheet is in path 27. CR3 being a one indicates that a copy sheet is in the vicinity of paper path 29. CR4 being a one indicates that a copy sheet is leaving fuser 31 adjacent copy path 33. CR5 being a one indicates that a copy sheet is entering path 34 or ISU 40. CR6-8 are associated with copy sheet transport in collators 14B, 14C. If all bits CR2-CR8 are active, i.e., binary ones, seven copy sheets are simultaneously in the copy paths 27–34. As a copy sheet leaves a portion of the copy sheet path the corresponding CR bit is reset to zero. As the copy sheets proceed down the path, higher numbered CR bits are set to one while the lower numbered CR bits are reset to zero.

Figure 6:
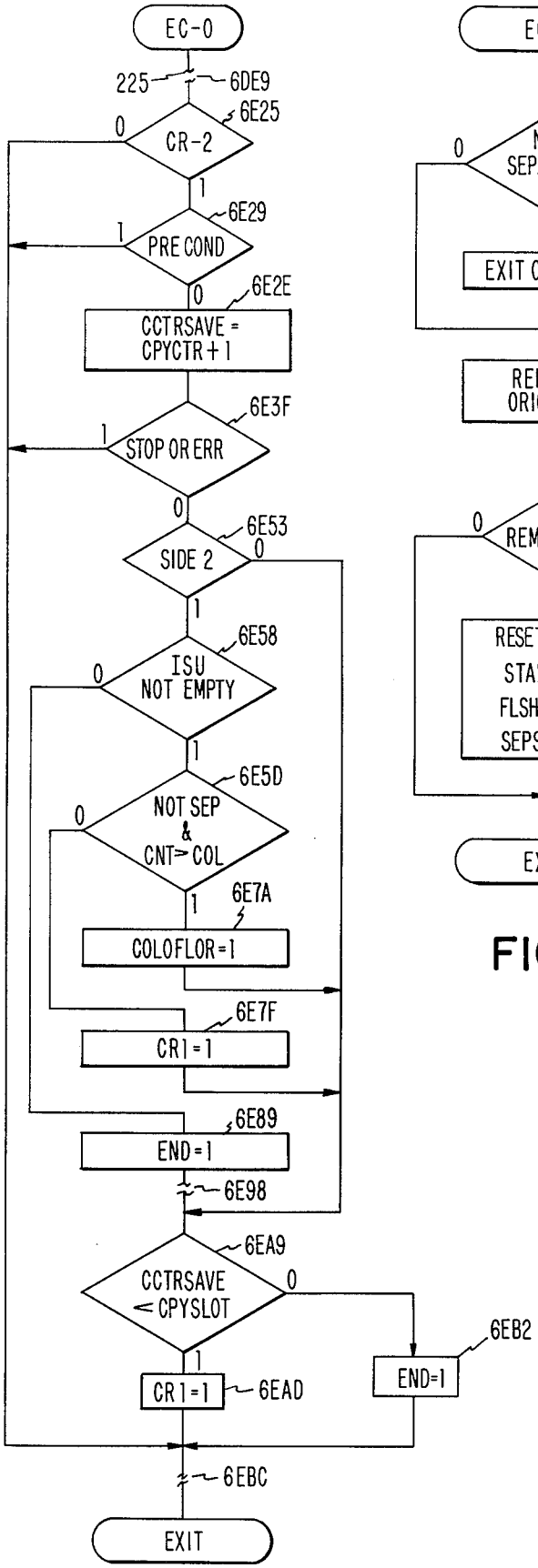
FIG. 6 is an instruction level flow chart showing that portion of an EC-0 program procedures used in connection with practicing the present invention.

FIG. 6 shows the EC0 program procedure as executed by copy microprocessor 170 at the beginning of each image cycle during an active copy producing mode of the copy production machine 10. After executing nonpertinent code procedures at 6DE9 of ROS control store 171, the status of the CR2 bit of CR 210 is sensed. If it is a zero, no action relating to ACR is taken at EC0. If CR2 is active (one), then the computer at 6E29 checks whether or not a preconditioning cycle of photoconductor drum 20 is being executed. Such a preconditioning is shown in U.S. Pat. No. 4,036,556. If preconditioning is occurring, EC0 actions by copy microprocessor 170 relating to the ACR are skipped. If it is not preconditioning, then the register CCSR 226 of working store 172 is made equal to the numerical contents of copy counter register 93A plus one. CCSR 226 is the backup register (counter save) for the copy counter register 93A for facilitating ACR functions. Then, at 6E3F, copy microprocessor 170 checks to see whether a stop or error condition is occurring in copy production machine 10. If so, EC0 is exited because the machine is being prepared to stop. On the other hand, the copy microprocessor 170 at 6E53 checks for the side two to be produced in the next copy run. If side two is active, then the ISU 40 is checked at 6E58 to see whether it is empty. If ISU 40 is not empty then the microprocessor at 6E5D checks whether or not a so-called separation mode is invoked. A separation mode in a copy production machine is that mode in which job separation sheets are inserted between successive or adjacent jobs. Furthermore, at 6E5D the count of copies to be produced is compared with the collator capacity to insure the latter is smaller. If both those conditions are satisfied, then a collator overflow request bit in register 186 is set at 6E7A.

If ISU 40 is empty at 6E58, then the end of the run is signified at 6E89 followed by nonpertinent procedures at 6E98. Also from 6E5D, if it is a separation mode or the count is less than the collator capacity, than a copy sheet is signalled to be picked by setting CR1 to "1" at 6E7F.

Following all of the above-described steps, the microprocessor 170 then compares the saved copy counter value in CCSR 226 with the copy select value in CS 72A which was entered from keyboard 71. If the saved value is less than the select value, then copy production has to ensue because of multiple copy runs joined into a single copy job. Accordingly, CR1 is set to one at 6EAD. If the condition of 6EA9 is not true, then it is the end of the run with the end condition flag being set at 6EB2. The EC0 program is exited after performing the nonpertinent code procedures at 6EBC.

Figure 7:
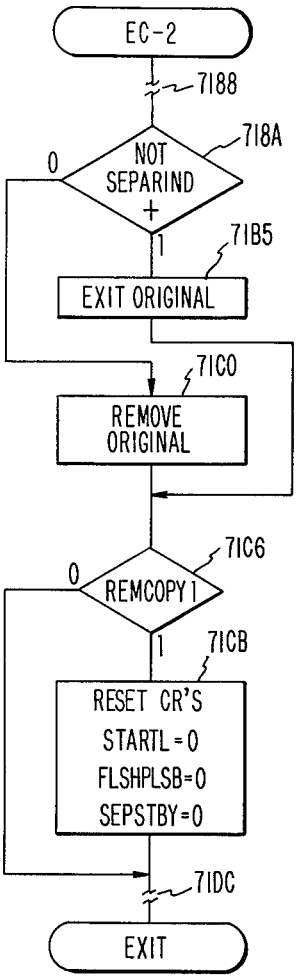
FIG. 7 is a flowchart similar to FIG. 6 but for a portion of EC-2 program procedures.

After the EC programs are executed, there are some subsidiary EC0 and EC1 CR programs not pertinent to the present invention. Next, the EC2 program shown in FIG. 7 is executed by copy microprocessor 170. This program starts out with some nonpertinent code procedures at 7188. The microprocessor checks via a branch instruction at 718A whether or not the separate mode indicator (SEPARIND) is active plus other nonpertinent conditions. If the separate indicator is not active and the other conditions are met, the original on the platen of SADF 11 is indicated to be exited via output instruction 71B5 (DOCEXIT shown in FIG. 2 is called). Otherwise, the remove document light 227 (FIG. 2) on panel 52 is illuminatd via the instruction at 71C0. Then, at 71C6, the remove copy 1 flag is checked. If it is active, then at 71CB the indicated flags are reset and CR 210 is reset to all zeros. Nonpertinent code procedures are executed at 71DC and then this synchronous operate program is exited. The above code illustrates one intimate relationship between the synchronous programs and the asynchronous program control operations of SADF 11.

Figure 8:
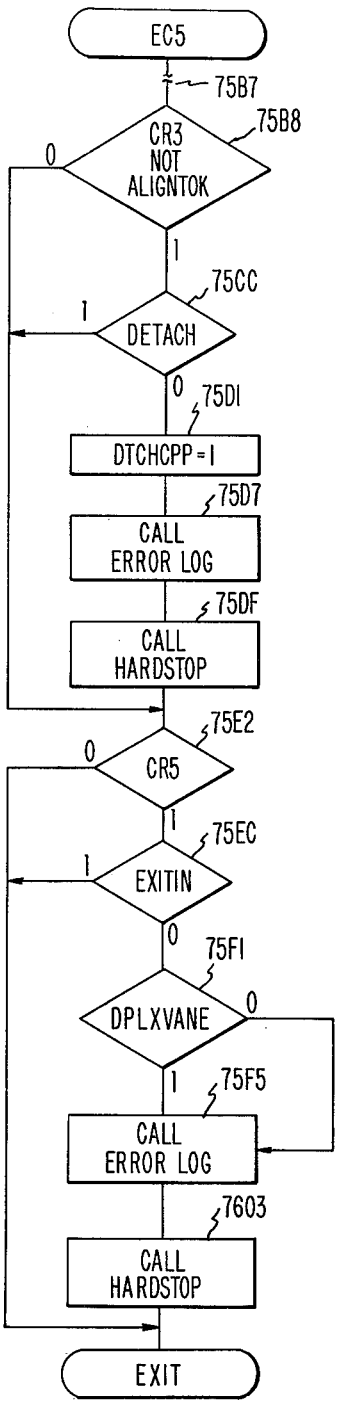
FIG. 8 is a flowchart similar to FIG. 6 but for EC-5 procedures.

The next operate program described in detail is the EC5 program shown in FIG. 8. First, some nonpertinent code is executed as indicated by 75B7. At 75B8, the CR3 bit of CR register 210 is checked plus a status bit indicating the alignment check at aligner 28 is verified. If there is no aligner error and CR3 is set to a one condition, then the microprocessor responds to the program at 75CC to determine whether or not a copy sheet has been successfully detached from photoconductor drum 20. If not, an error condition of detach failure is set at 75D1 (DTCHCPP means detach error in the copy paper path). The error detected is logged by the computer by calling an error log routine (not shown) at 75D7 and hard stop program 220 is called at 75DF. The steps 75D1 through 75DF are omitted if the branch conditions are other than above described.

The EC5 program execution continues at 75E2 by checking the CR5 bit of CR 210. If it is a binary zero, the remainder of the program is skipped by copy microprocessor 170. If it is a one then the computer checks for an exiting copy sheet (EXITIN) at 75EC. If a copy sheet is exiting, operation is proper and the program is exited for EC6. On the other hand, if a copy is not being exited at 75EC, then the microprocessor checks at 75F1 to determine the status of the duplex vane 42. If the duplex vane is active, i.e., copies are going into ISU 40, then the error log at 75F5 is called for indicating an error condition relating to the ISU 40. On the other hand, if the duplex vane is not operative, then another part of the error log is invoked for recording a nonduplex error relating to the copy transport path 33. After the error logging, the hard stop program 220 is called by the microprocessor at instruction 7603. The above description illustrates detection of certain types of errors in copy production machine 10 by copy microprocessor 170, the resultant logging of such errors, and then calling a hard stop program 220 for stopping copy production machine 10 in a manner which will become apparent.

Figure 9:
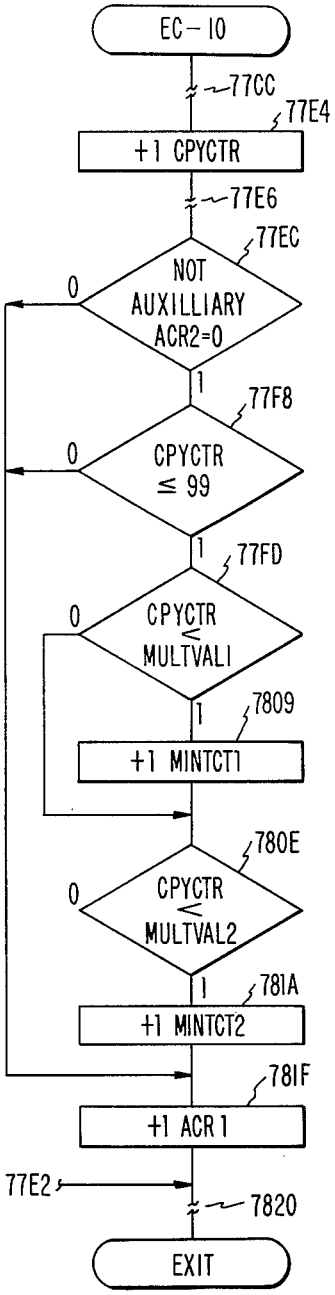
FIG. 9 is a flowchart similar to FIG. 6 except it is for procedures at EC-10 time.

Following EC5, the computer executes the programs EC6 through EC9 which are not pertinent to an understanding of the present invention. Finally, it executes EC10 which, among other things, adds one to ACR1 for indicating a copy sheet has successfully entered the copy path past aligner 28. As seen in FIG. 9, after executing the nonpertinent code procedures 77CC which verify that the state of CR2 is unity and that a copy sheet has been picked satisfactorily, the copy counter register 93A is incremented at 77E4. This count field is used in counting the number of copy sheets picked during each copy run. There follows more nonpertinent code procedures at 77E6, which includes a series of branches and counting steps that are not pertinent. At the branch 77EC, microprocessor 170 senses whether or not an auxiliary function is being performed, i.e., separation, flush, etc. If an auxiliary function is not being performed (copies are being produced), the ACR1 register is incremented at 781F. However, ACR1 is also a count field which keeps a tally of the number of copies in the paper path when one image is being produced or if no images are being transferred. The codes procedures at 77F8 through 781A concern counting steps pertinent to copy production. Then more nonpertinent code procedures at 7820 are performed. These procedures may follow a branch in nonpertinent code at 77E2 as a part of 77CC.

Copy microprocessor 170, after executing EC10, executes EC11-EC16. During these latter portions of the image cycle of CPP 13 represented by EC11 and EC13, a copy sheet should be leaving a billing exit such as is indicated by sensing switches 102, 105 or 110. Accordingly, these nonpertinent code procedures will call the EXITLEAV program 207 to be executed by copy microprocessor 170. EC11 will call EXITLEAV when the CR5 bit of CR register 210 is a binary one and the machine is built for the so-called B4 size of copy paper. This means that the trailing edge of the copy sheet should be leaving the exit for indicating a successfully produced copy. The copy microprocessor 170, when executing EC13, on the other hand, checks for the CR5 bit of CR 210 for billing non-B4 type sizes. That is, for timing consideration with respect to rotation of photoconductor drum 20 the copy made in B4 machines should be successfully exited to the output portion 14 intended destination prior to the legal size of the non-B4 machines, i.e., those machines which make copy sheets the size 8.5×11" or 8.5×14", for example.

Figure 10:
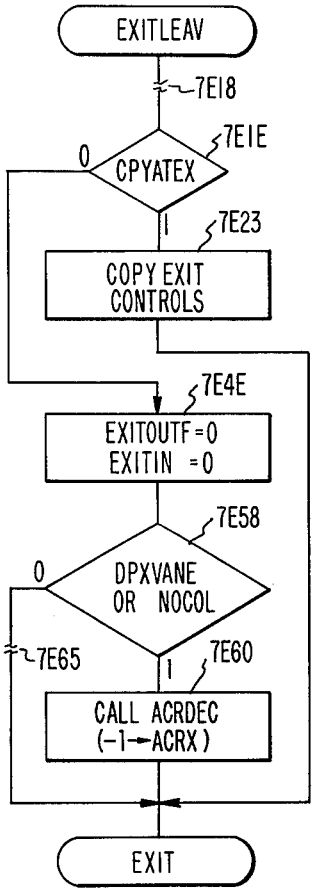
FIG. 10 is a flowchart similar to FIG. 6 except for so-called exit leave procedures for down counting transient counts.

The copy microprocessor 170 responds to the EXITLEAV program for verifying that each copy produced had been successfully sent to its intended destination and logs an exiting error if one occurs. As can be appreciated, several steps related to this function are not pertinent to automatic copy recovery. Accordingly, as seen in FIG. 10, copy microprocessor 170 first executes some nonpertinent code procedures as indicated by 7E18 and then it checks for a copy at the exit at 7E1E. If there is a copy at the exit, then a plurality of instructions related to copy exit controls and logging errors are executed at 7E23 and the program is exited directly. At this point in time it should be noted that the copy sheet is still under the billing exit switch, such as switch 102, 105 or 110 and a successfully completed copy has not yet been produced.

On the other hand, if there is no copy at the exit switch at 7E1E (copy has been completed), then the flag indicators for indicating a copy is entering the exit switch or just going out of the exit switch are reset to zero at 7E4E. Then at 7E58, copy microprocessor 170 checks to see if the duplex vane 42 is in the down position for providing copies to ISU 40, i.e., side one is being produced and not to be billed, or if no collator is present, i.e., all copies go to exit tray 14A. If this is the case, then the copy microprocessor at 7E60 calls ACRDEC 208 for decrementing ACRX, i.e., the highest enumerated nonzero ACR register 127A. If not, some nonpertinent code represented by 7E65 is executed relating to certain collator control functions.

Figure 11:
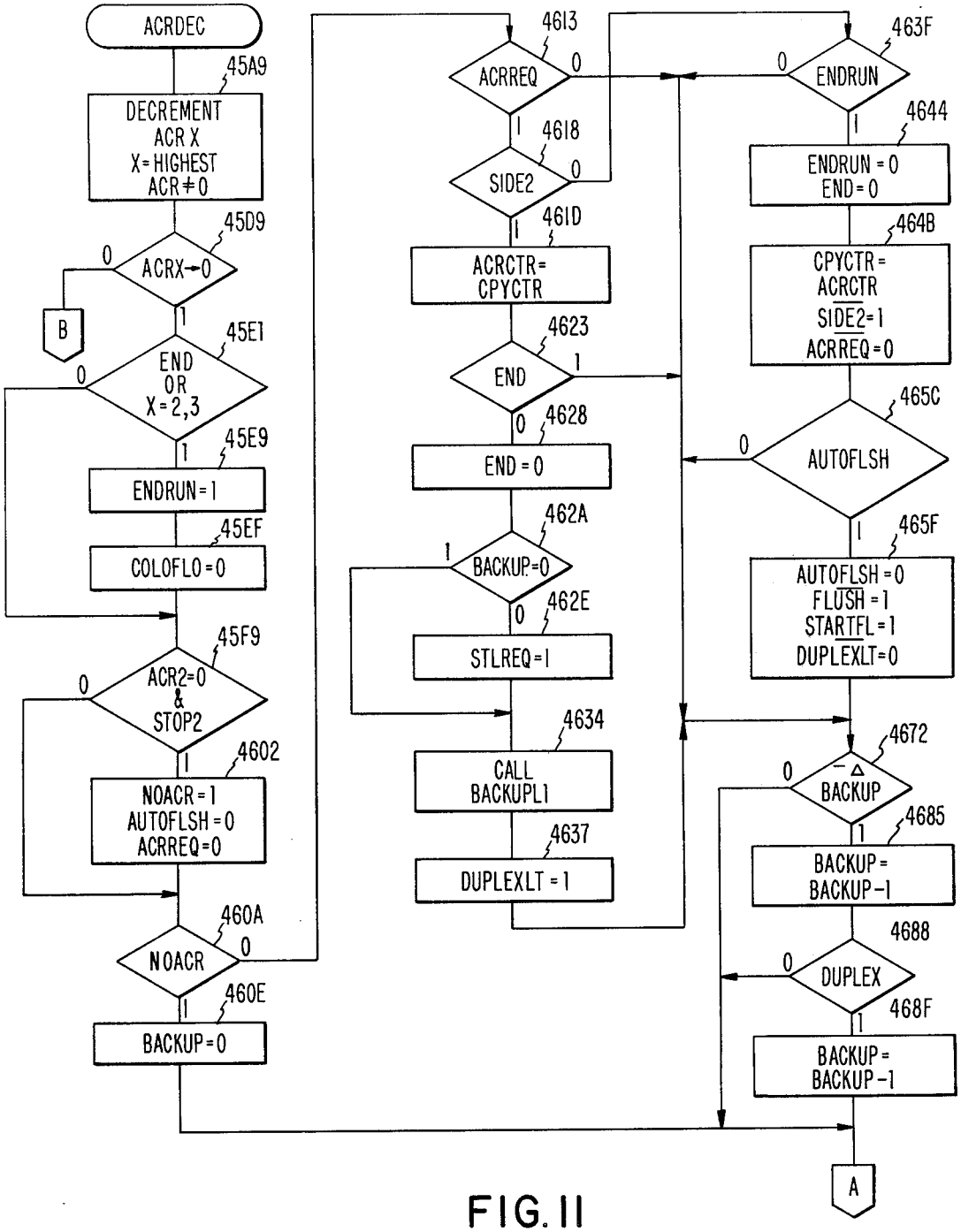
FIG. 11 is a flowchart similar to FIG. 6 except it shows procedures to decrement the copy recovery separate counts.

ACRDEC 208 is called by EC11 or EC13 and, as above described, decrements ACRX each time a successful copy has been produced and supplied to its output portion 14 destination. As seen in FIG. 11, the copy microprocessor 170 decrements ACRX at 45A9, where X is the highest nonzero ACR register. Copy microprocessor 170 checks for ACRX going to zero at 45D9. This action determines whether or not a possible end of a copy production run is occurring. Accordingly, at 45E1 copy microprocessor 170 checks for the end flag, i.e., some other condition in the copy production machine 10 has indicated end of the copy production run or whether or not the value of X is two or three. If the value of X is two or three, then the only remaining nonzero ACR is ACR1 which means that the end of copy production is imminent. This status is indicated by the copy microprocessor setting the ENDRUN flag to one at 45E9 and resetting the collator overflow flag at 45EF. If X was not two or three and the end flag was not set, the justdescribed steps are omitted. Copy microprocessor 170 continues checking at 45F9 by determining if ACR2 is equal to zero and a step two flag has been set. That is, a stop indication has been received by copy microprocessor 170 from control panel 52. If so, then the copy microprocessor 170 at 4602 sets NOACR to one, i.e., there will be no copy recovery action, and resets the ACR request flag and the automatic emptying of ISU 40 flag to zero. If neither of the conditions at 45F9 are met, the above-described step is omitted.

Copy microprocessor at 460A checks to see whether or not the NOACR flag is set. If it is set, then the backup register 188 (containing the number of images in the copy path) is reset to zero at 460E and the FIG. 12 portion of ACRDEC is entered. If ACR is still possible, then the microprocessor checks for the ACR request at 4613. If no ACR request is outstanding, then the following described steps are omitted with the copy microprocessor going immediately to the step at 4672 for decrementing the image backup count in register 188. Upon an ACR request being active, copy microprocessor 170 checks to see whether or not a side two indication is active at 4618. If so, the following steps are performed; if not, such steps are omitted. For a side two, the microprocessor makes the ACR count equal to the copy count at 461D. The ACR count is a memory register 230 for memorizing the value in the copy count register 93A during ACR. Then "end" is checked at 4623 for determining whether or not it is the end of a run. If not, the end flag is reset at 4628.

The value of image backup register 188 is checked at 462A. If it is zero, a start latch request is set at 462E for enabling restarting copy production machine not in the ACR mode. If it is nonzero, the BACKUPL1 program 225 is called at 4634 for illuminating one of the indicators 86, 87 or 88. Then at 4637, the duplex light is reilluminated, i.e., if side two is active at 4618, the duplex mode must have been selected and ACR is occurring during the duplex mode.

The copy microprocessor 170 goes to the instruction at 463F from 4618 to determine whether or not the end run flag, i.e., the imminent end of copy production has been set. If not, the following steps are omitted; if the end of the run is imminent, then the copy microprocessor 170 at 4644 resets the end run flag and the end flag. At 464B, three instructions are represented wherein the copy counter is made equal to the ACR counter because at 461D the ACR counter was set to the copy counter contents. It should be appreciated that during each copy recovery the ACRDEC 208 is performed many, many times as are the other programs, and that as the conditions of the copy production machine 10 change, the execution of the programs change to achieve the program implemented procedures described herein. Returning to 464B, side two is set to the one condition and ACR request is reset, i.e., ACR has been finished.

Then at 465C, copy microprocessor determines whether or not ISU 40 should be emptied. If not, step 465F is omitted; if so, the flag is reset and in another instruction the flush mode (emptying of ISU 40) is activated, a start flush flag is activated, and in the third instruction the duplex light is extinguished. The duplex light is shown as item 231 in FIG. 2.

The copy microprocessor performs instruction 4672 from either 465F, 4537, 465C, 4623, 463F or 4613. By this instruction, copy microprocessor 170 determines whether or not the image backup register 188 should be decremented because one of the ACR has gone to zero. If any has gone to zero, then backup register 188 should be decremented. This is determined by the conditions that there is no ACR request, end run flag is active, the ISU 40 is empty, and it is not the so-called separation mode. If those conditions are met, then at 4685 copy microprocessor 170 decrements the backup register 188. Following that decrementing, copy microprocessor 170 checks for the duplex mode at 4688. If it is in a duplex mode, then the backup register is again decremented at 468F. It should be remembered that the ACR registers count images, not copy sheets. In the illustrated simplex ACR, there is one image per copy sheet; therefore, the ACR registers would be only decremented once. However, during the duplex mode there are two images, one of each side, on each copy sheet. Therefore, for recovery control, the backup register 188 is decremented twice each time a duplex copy sheet is successfully deposited in output portion 14.

Figure 12:
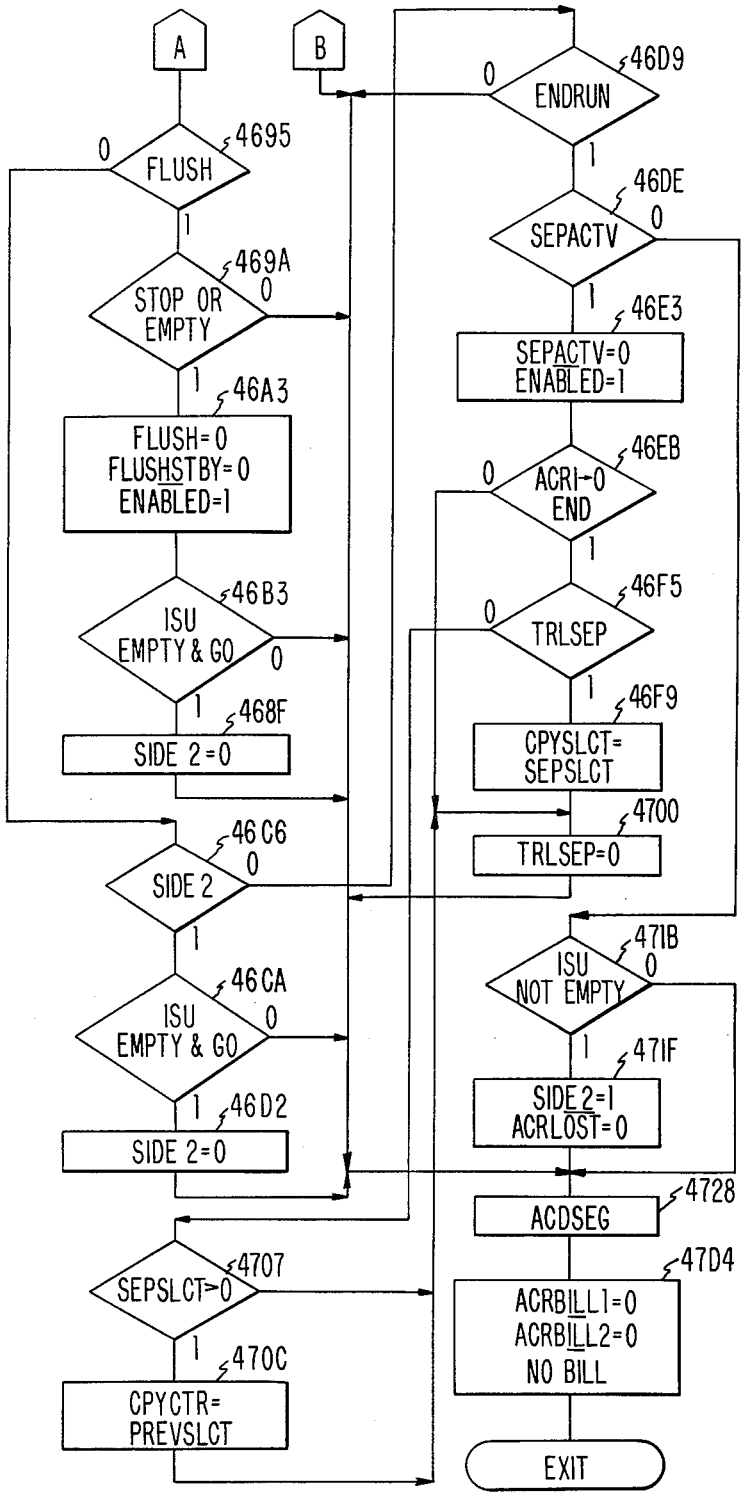
FIG. 12 is a flowchart extension of FIG. 11.

Turning now to FIG. 12, from the "A" connector from instruction 468F and others as seen in FIG. 11, the copy microprocessor determines whether or not ISU 40 is being emptied (flush) at 4695. If so, at 469A copy microprocessor 170 determines whether or not the stop condition is active, i.e., the machine is about to stop, or ISU 40 is empty. If so, at 46A3, copy microprocessor 170 resets the flush flag and the flush standby flag for extinguishing the "please stand by" illuminated indicator 232 of FIG. 2. It also sets enable equal to one for enabling the number of copies to be produced to be displayed on panel 52 in a three digit decimal display (not shown). Then at 46B3, copy microprocessor checks to see whether or not ISU 40 is empty; this and other conditions enable the copy production machine to proceed. These other conditions include stop conditions off and duplex light off. If all are true, at 468F side two is reset for enabling production of a side one.

Returning to 4695, if ISU 40 is not being emptied as indicated by the zero in the flush bit, the side two indicator is checked at 46C6. If it is active, then at 46CA the same conditions are checked as were checked at 46B3. If those conditions are met the copy microprocessor 170 resets the side two indicator at 46D2. Then the copy microprocessor will perform instruction steps 4728 and 47D4 from either 46D2, 46CA, 468F, 46B3, 469A and to be described instruction 46D9, as well as from the FIG. 11 instructions indicated by connector "B". The copy microprocessor at 47D4 controls the billing program 184. The effect of the instruction at 47D4 resetting ACRBILL1 permits billing to occur, i.e., there is no copy recovery occurring. ACRBILL2 being reset merely resets the flag indicating that a billing operation was occurring when a hard stop 220 was called.

Another major portion of the FIG. 12 illustrated section of ACRDEC is from 46C6 when side two is not active. At 46D9, copy microprocessor 170 checks for the end run flag. If it is active, it checks for the separation active, flag at 46DE. If both are active then at 46E3, copy microprocessor 170 resets the separation active flag and enables display of the copy selection. Then at 46EB, copy microprocessor 170 checks to see whether the value contained in ACR1 went to zero or the end flag was set. If so, the trailing separator flag, indicating that a separator sheet was sent out after completion of the copy production run, is checked at 46F5. If so, then at 46F9, copy microprocessor 170 sets the copy select register 72A equal to a separation select register (not shown). Separation select register performs a memory function in the same way that the ACR counter performs the memory function. Then the trailing separator flag is set to zero at 4700.

Returning to 46DE, if separation mode is not active, they the copy microprocessor 170 checks for ISU 40 being empty at 471B. If it is not empty, then side two is set to one at 471F. The second instruction, step of 471F, resets ACRLOST register 187 to zeros, i.e., the number of copies registered in ACRLOST is zeroed out or erased. Then, a later described program ACDSEG 209 is performed beginning at 4728. Then instruction 47D4 is performed before exiting.

Figure 13:
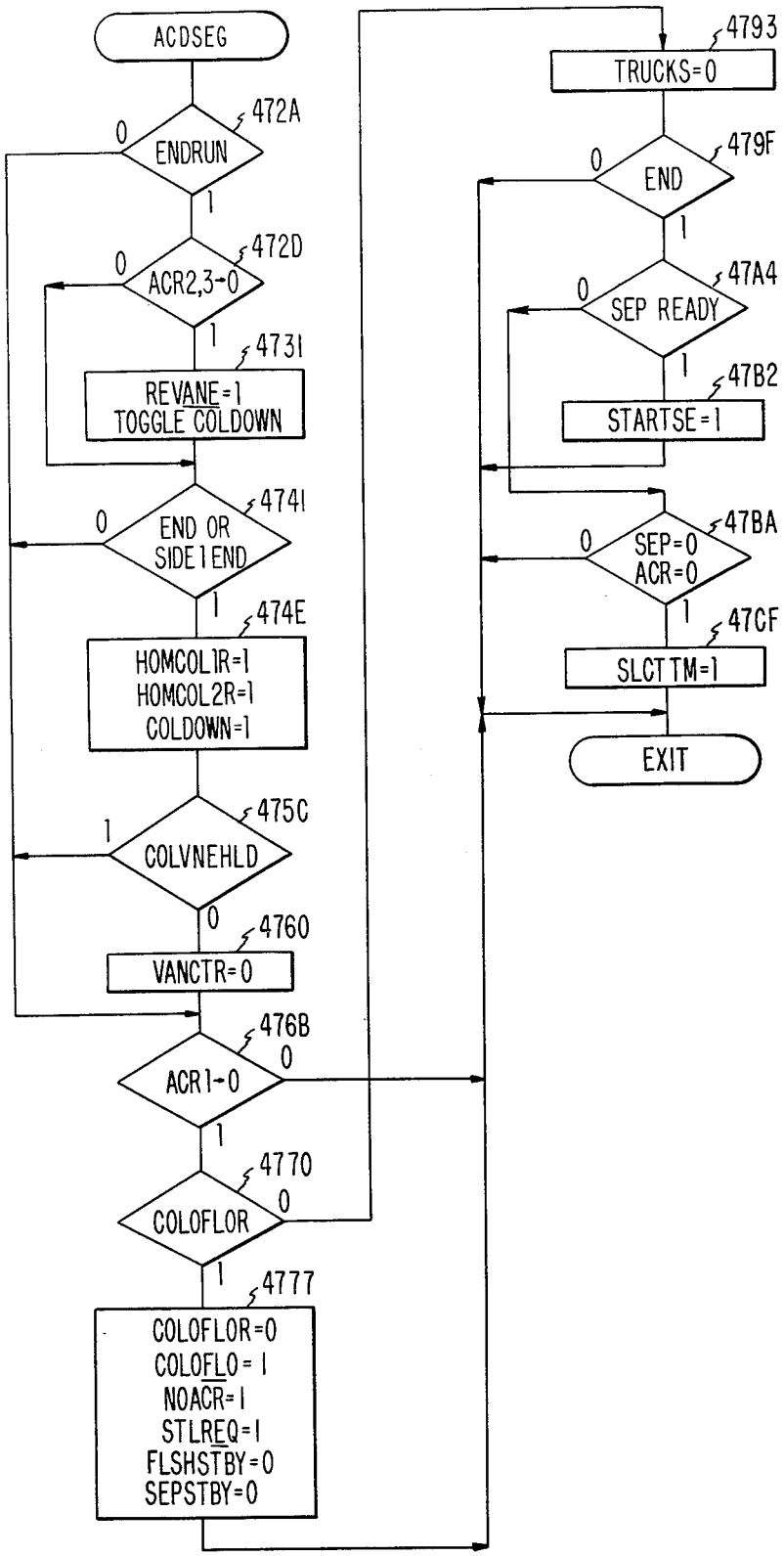
FIG. 13 is a flowchart similar to FIG. 6 except it shows procedures of a segment of the FIG. 11 illustration.

The instruction procedural flow chart for ACDSEG is shown in FIG. 13. Copy microprocessor 170 at 472A checks for the end run flag, i.e., imminent end of a copy production run. If the condition is not true, the microprocessor then skips to instruction step 476B as later described. If the end run is active and ACR2 or 3 went to zero as checked at 472D, copy microprocessor 170 sets the return collator vane switch to one and toggles the collator down flag at 4731. This is a collator control concerned with bidirectional collation and is effected when the end of a copy production run occurs before another one is to start. Then at 4741, copy microprocessor 170 checks for a side one end indication or an end indication. If either is true, then the copy microprocessor 170 at 474E returns the collating vane to its home position and sets the collate down flag to one so that the next collate run will collate from the top to the bottom of the collators 14B or 14C. Then at 475C, whether or not the collator vane is to be held is checked. If not, the vane counter is set to zero at 4760 so that it can start counting bins in a downward collation mode.

The copy microprocessor 170 at 476B checks to see whether or not ACR1 went to zero. If it did, then it checks the collator condition at 4770. If the collator was active, then at 4777 certain flags are reset and set, ACR is inhibited, a start latch request is activated, and the standby light 232 is extinguished be resetting the flush and separation standby flags.

From instruction step 4770 in a noncollate operation, the instruction step 4793 enables copy microprocessor 170 to reset the copy sheet picking trucks (not shown) of ISU 40 and copy sheet supplies 35 and 35A to a reset or nonpicking position. At 479F, the end flag is checked. If the end flag is active, the separation ready, flag is checked at 47A4. If it is ready then the separation mode is initiated at 47B2 by setting that flag to the active condition. If separation is not ready, then at 47BA the copy microprocessor 170 checks for separation equal to zero and ACR equal to zero (NOACR). If those are true, then keyboard 71 is enabled by setting the SLCTTM flag to the active condition.

Other program procedural steps and their interaction with respect to the ones described are seen from an inspection of FIG. 13.

Figure 14:
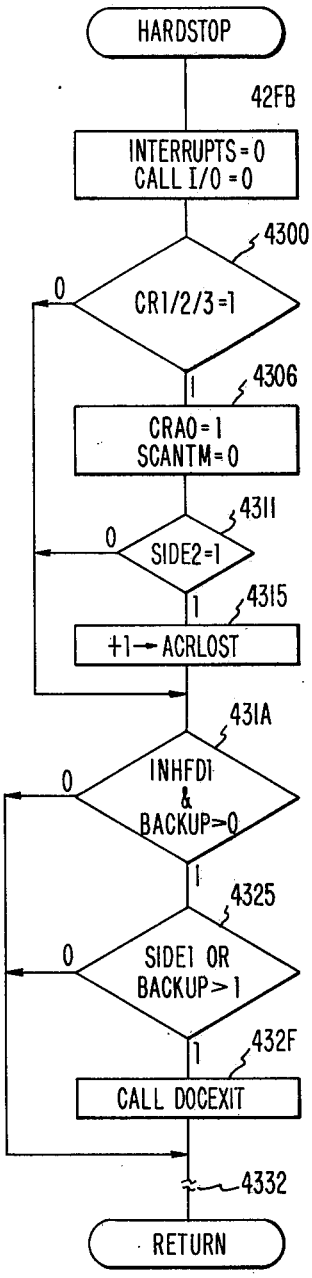
FIG. 14 is a flowchart similar to FIG. 6 except that it partially illustrates procedures to stop the copy production machine upon detection of a predetermined error condition.

FIG. 14 is an instruction level stopping procedural flow chart for the hard stop program 220. In order to hard stop without interference from machine 10 interrupts, the interrupts are turned off at 42FB. Additionally, all of the I/O registers 173, 174 are set to zero. Next, the copy microprocessor 170 proceeds to initiate the hard stopping operation. At 4300 it checks for the value of CR1, 2 and 3 of CR 210. If any of these are one, i.e., a copy sheet is to be picked or it just has been picked, then flags are set at 4306 for remembering that condition. These flags are CRA0 which is in the status register 186 and serves a memory function for remembering that a sheet of paper was to be picked at the time a hard stop occurred. Also, SCANTM is reset. SCANTM inhibits fuser 31 heating during a predetermined portion of an original document scan by input optics 12. Then at 4311, side two flag is checked. If it is active, then one is added to the ACRLOST register 187. This addition indicates the second image of a duplex copy sheet. From the above steps, the branch at 431A is performed. If a SADF 11 flag INHFD1 is active and the value in the backup register 188 is greater than zero, then branch instruction step 4325 causes microprocessor 170 to check for side one or backup greater than one. If these conditions are true, a document is resident in SADF 11. INHFD1 indicates that the semiautomatic document feeder 11 is being used for the production of copies. Therefore, calling the document exit routine at 432F then exits a document while copy production machine 10 is stopping via the hard stop program 220. By exiting a document before other recovery procedures, the document is in the document collection tray 90 ready for pickup by the operator. Note that the original is exited from SADF 11 irrespective of whether or not copies were in fact made from the original document being exited. Nonpertinent code procedures are executed at 4332 and then the copy microprocessor 170 returns to the calling program using well known branch and link techniques.

Having shown the operate programs 180 and the stop programs 181, the next step in ACR is execution of recovery program steps 182 by copy microprocessor 170. In this regard it may be noted that the programs may be entered many, many times before the ACR is actually completed because that the execution of programs by copy microprocessor 170 is much faster than the operation of copy production machine 10. Therefore, although each program is described only once, the various paths through the program should be kept in mind for understanding the repetitive paths for ACR in the repetitive execution of programs by copy microprocessor 170 in executing the procedures of the present invention.

Figure 15:
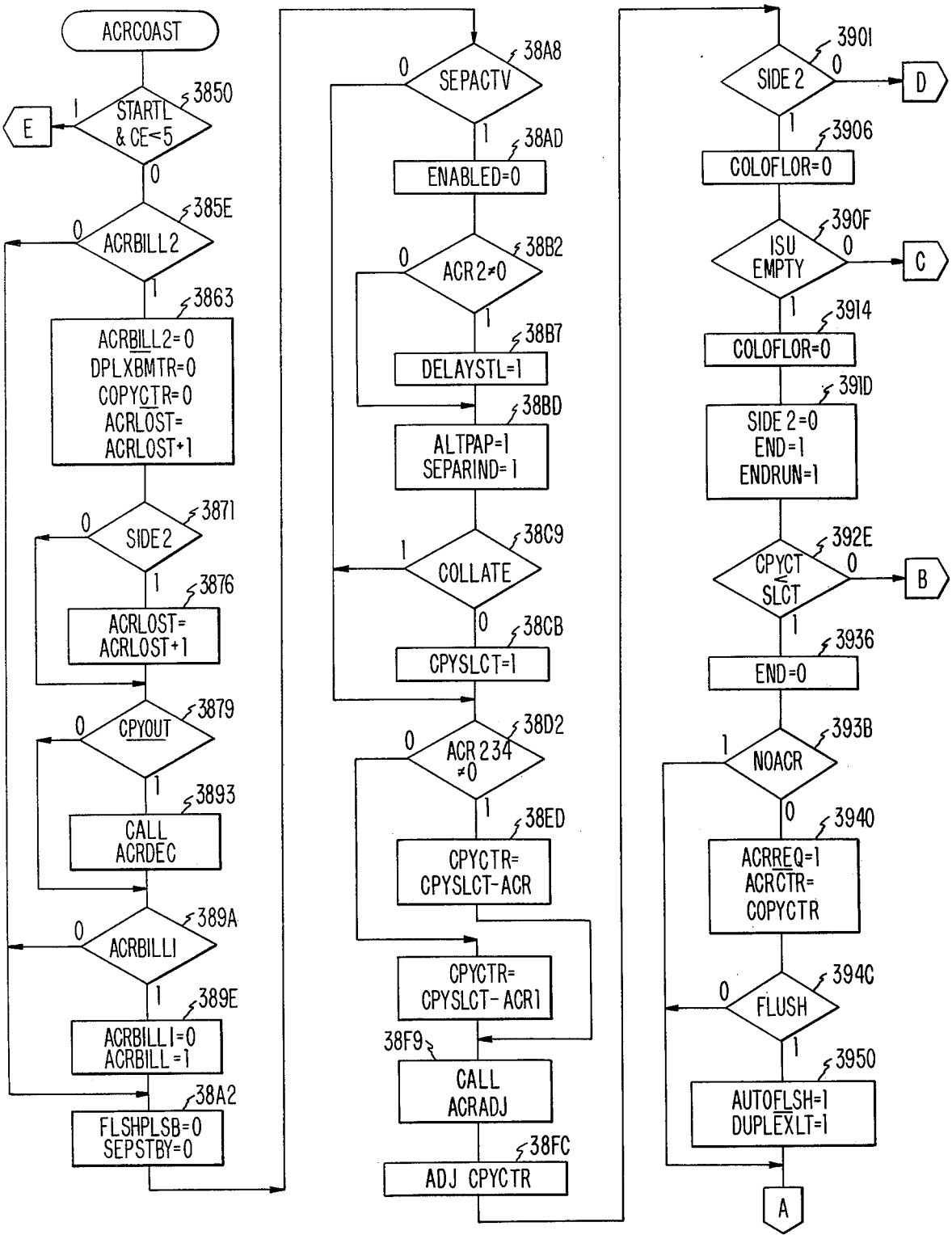
FIG. 15 is a flowchart showing operation of the programmable control when the photoconductor member has coasted to a stop and accenting that portion relating to copy recovery.
Figure 18:
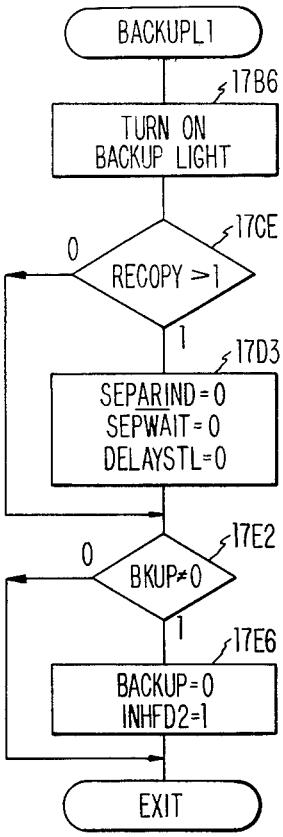
FIG. 18 is a flowchart which shows a control for turning on operator indicators for effecting recovery.
Figure 19:
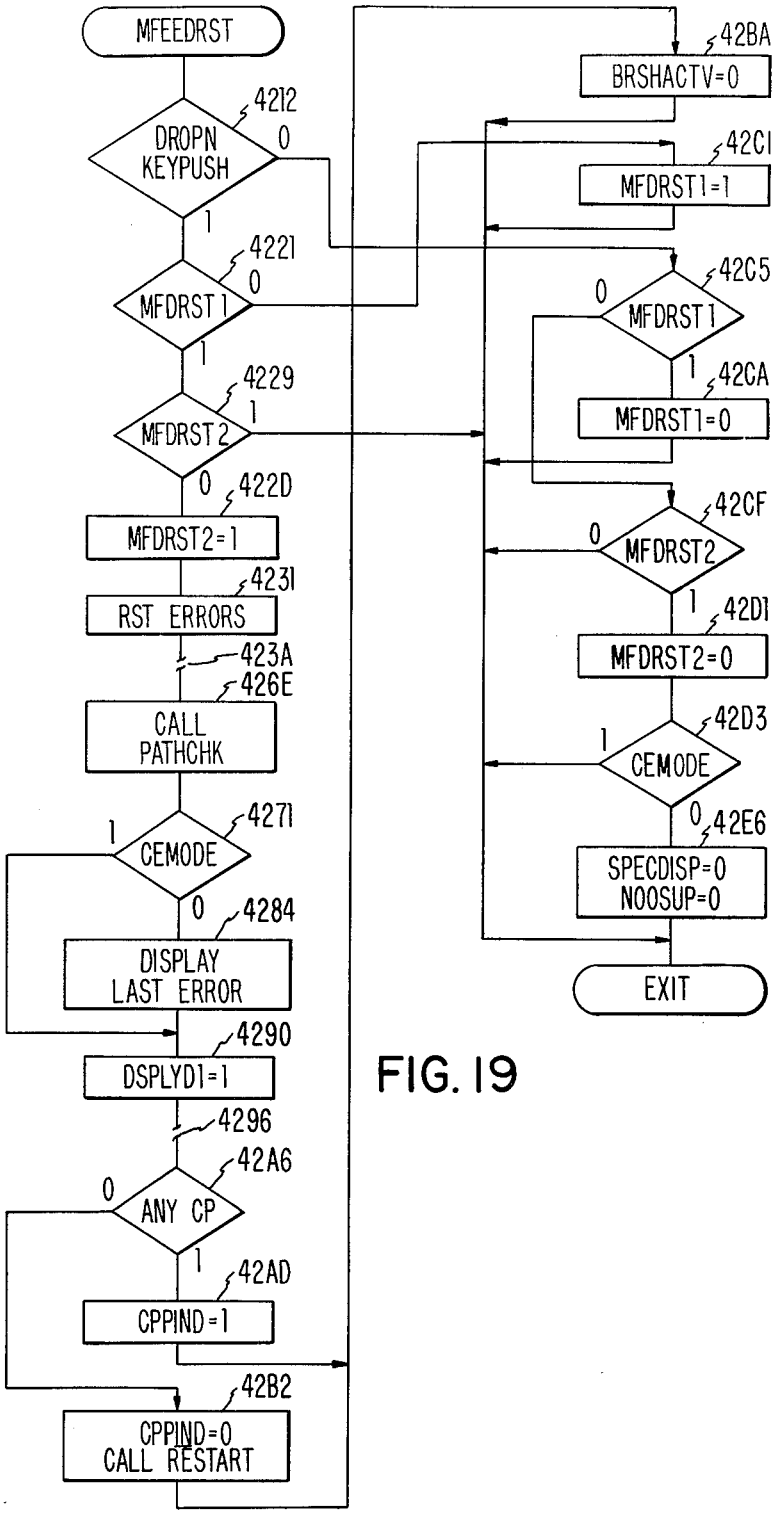
FIG. 19 is a flowchart which shows operation after the operator has actuated a so-called misfeed reset switch.

In to FIG. 15, the instruction level procedural flow chart for ACRCOAST shows copy microprocessor 170 first checking the start latch state (a bit in status registers 186) and whether or not a CE mode is active, at 3850. If the CE mode is active the program is exited as indicated by the offpage connectors "E" in FIGS. 15 and 16. Otherwise, an ACR bill indicator is checked at 385E. If ACRBILL2 is active, then it is reset at 3863. Other steps in the same box include resetting copy counter register 93A to zero and incrementing the ACRLOST register 187 by one. When the ACRBILL2 is active, it means that a copy sheet was under the billing exit switch and, therefore, one more copy sheet has been lost in stopping machine 10. This one more sheet being under the billing exit switch indicates it was billed; therefore, on recopy, the replacement copy sheet should not be billed. Then at 3871, copy microprocessor 170 checks the side 2 status indicator. If it is one, then a copy sheet in ISU 40 (already carrying one image) was lost. Therefore, ACRLOST is again incremented for showing that two images on the duplex copy sheet have been lost. Then at 3879, copy microprocessor 170 checks to see whether the billing meter would be operated off the collator vane switch 105 or 110 and the appropriate exit switch was not active, i.e., the copy sheet has already left the machine and is a good copy sheet. If so, the ACR registers 127A should be decremented. Accordingly, ACRDEC 208 is called at instruction step 3893. If the copy did not make it out of the machine, the call at 3893 is omitted and copy microprocessor 170 checks for inhibition of billing at 389A. If billing was inhibited, e.g., a copy jam occurred during a recovery procedure, then at 389E ACRBILL1 (inhibit billing) is reset. That is, billing is not inhibited. Also, ACRBILL is set to the active condition for enabling the billing meter M. If the ACRBILL2 was inactive, i.e., a copy sheet was not under the exit switch when machine 10 stops, then all of these steps are omitted and copy microprocessor 170 at 38A2 resets the standby indicator 232 by resetting the indicator flags. Then at 38A8, copy microprocessor 170 checks to see whether or not the separation mode is active. If not, the following described steps are omitted with the copy microprocessor performing the instruction at 38D2. The intermediate steps for separation mode being active includes resetting th enabled flag at 38AD for disabling the panel 52 multidigit display (not shown). Then at 38B2, the value of ACR2 is checked; if ACR2 is not zero, the copy run has not yet been completed and the delay start latch (a bit in status registers 186) is set at 38B7. This means that there were copies for more than one image in the copy path at the time of stopping copy production machine 10.

The alternate paper selector for selecting copy sheet supply 35A is set to one at 38BD and the separate indicator is set. This means that the separation mode will occur during copy recovery prior to any copy production. That is, if the copy sheet jam occurs when separation sheets are being supplied, then the ACR enables the copy production machine automatically to recover by automatically supplying the appropriate number of separation sheets. Then copy microprocessor 170 at 38C9 checks to see whether or not the collator is being used. If not, the copy select register 72A is set at 38CB. In noncollate mode, only exit tray 14A is used; therefore only one separator sheet is supplied. Otherwise, the number of separator sheets will be a number of sheets equal to one of the values of the ACR registers. For example, if the separator sheets were in ACR3, then the number in ACR3 will indicate to copy production machine 10 the number of separation sheets to supply to the collator 14B, 14C for recovery.

Next, the copy microprocessor 170 at 38D2 checks to see if any ACR other than ACR1 is not equal to zero, i.e., whether a multiple run was involved in the jam error condition. If so, copy counter 93A should be decremented by the number of copy sheets lost. This is done at 38ED where the copy counter 93A is equal to the copy select register 72A minus the value in ACR 127A. If ACR2, 3 and 4 are equal to zero, then only ACR1 is involved. Then the copy counter register at 93A is made equal to the copy select register 72A minus the value in ACR1. It should be noted that the copy select register 72A at 38ED is equal to the ACRX, i.e., the highest numbered copy nonzero ACR register.

The copy microprocessor joins the two branches of the program procedure at 38F9 by calling ACRADJ 224. ACRADJ is later described with respect to FIG. 17 for showing the calculation to adjust the copy counts. The remainder from the ACRADJ subtraction is then stored in the copy counter register 93A by copy microprocessor 170 at instruction step 38FC which merely transfers the contents of an accumulator (not shown) within copy microprocessor 170 to register 93A.

After the adjustment has been made, copy microprocessor 170 checks for the side two indicator at 3901. If side two is active, then at 3906 COLOFLOR (collator overflow request bit in registers 186) is set to zero. At 390F, ISU 40 is checked to see whether or not it is empty. If it is empty, then at 3914 and 391D side two indicator is reset, end is set to one, and end run is set to one. Since ISU 40 was empty, any side two operation must have been completed. Therefore, the end of the copy production run is indicated by the end flag and the end run flag. Then at 392E, the relative values of the copy select register and the copy count registers, respectively 72A and 93A, are compared. If the copy count is less than the select count, then it cannot be the end of the copy run; therefore, microprocessor 170 resets the end flag of 3936.

Then at 393B, copy microprocessor 170 checks whether or not automatic copy recovery is to be suppressed or inhibited as indicated by the NOACR flag of registers 186. If NOACR=0, then at 3940 ACR request is set to one and the ACR count is set equal to the copy count 93A. Then, whether or not the ISU 40 should be emptied, is checked at 394C (flush). If so, automatic flush on restart is set at 3950 and the duplex light 231 is illuminated. It should be noted that the duplex light 231 is a combination illumination indicator and a push button. If NOACR=1, then ACR is inhibited.

Figure 16:
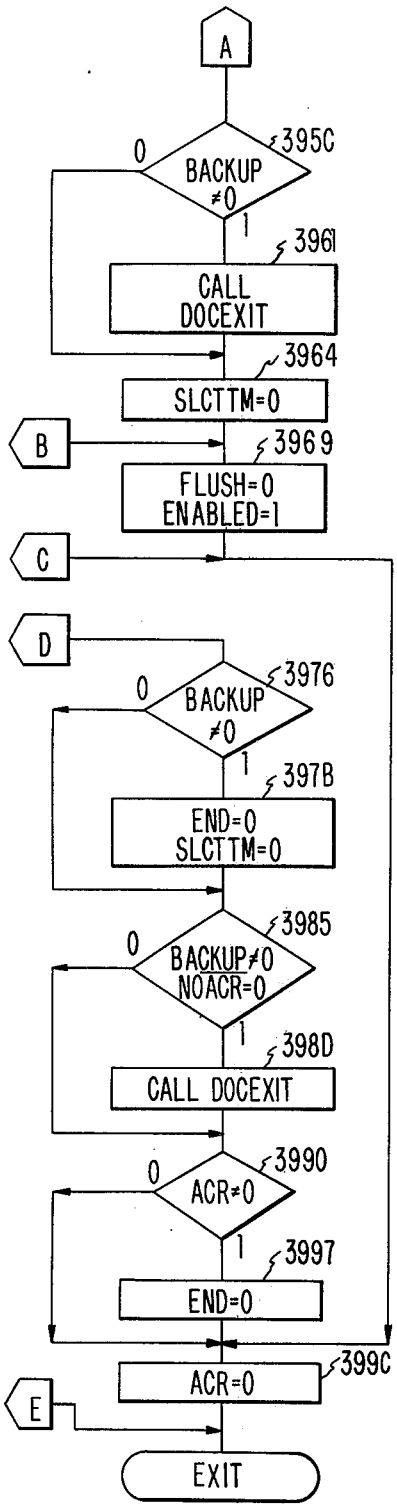
FIG. 16 is a flowchart extension of FIG 15.

The remainder of the description of ACRCOAST is made with respect to FIG. 16. From offpage connector "A", instruction step 3950 (FIG. 15), copy microprocessor 170 does the instruction step at 395C to check whether or not the backup register 188 has a value of zero. If it is not zero, then any document in SADF 11 is exited by calling DOCEXIT program 193A at instruction 3961. The backup count equal to zero means that the image in copy production machine 10 that was lost on the jammed copy sheets is the image of an original in SADF 11. Such a single original should be left in SADF 11 to facilitate recovery. Therefore, to recover, all the operator has to do is to push the start button after clearing the machine of the jammed copies. Therefore, it is desirable that such an original remain within SADF 11 for simplifying recovery. Compare this action with the hardstop procedures of FIG. 14 where more than one image is lost. Then the original document in SADF 11 is exited at an early time also to facilitate recovery.

Then at 3964, further selections are inhibited by resetting SLCTTM. Instruction step 3969 is entered also from offpage connector "B" of FIG. 15 (branch instruction 392E). The copy microprocessor resets the flush flag and enables display of copies selected and copies counted by setting the enable flag. Following the instruction at 3969, the offpage connector "C" from the FIG. 15 (instruction 390F) joins the program step path of procedures for resetting ACR to all zeros at 399C before exiting ACRCOAST, i.e., ACR calculations have been completed.

Offpage connector "D" from instruction step 3901 of FIG. 15 enables copy microprocessor 170 to execute branch instruction 3976 for detecting the value stored in backup register 188. If it is nonzero, then the end flag, i.e., the end of the copy production run is imminent, is reset and selection is inhibited by the execution of instruction step 397B. If backup is equal to zero (the zero exit of path 3976), then the copy microprocessor at instruction step 3985 checks the combination of backup not zero and NOACR=0 (ACR is permitted). If these conditions are true, then the DOCEXIT program 193A is called by the microprocessor at 398D. That is, more than one image on the original in SADF has been lost requiring exiting a document (if still there) for recovery. Then at 3990, if the numerical contents in ACR register 127A are nonzero, then the end flag is reset at 3997 and instruction 399C is executed.

All of the above actions of ACRCOAST are performed by copy microprocessor 170 immediately after the photoconductor drum 20 has coasted to a stop as indicated by a timer. At this time the operator must remove the copy sheets from the paper path while the copy microprocessor 170 continues repeating the steps for completing recovery from the jam condition as soon as the operator completes the removal of jammed copy sheets.

Figure 17:
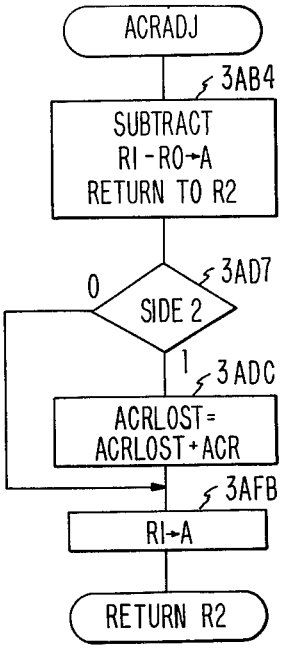
FIGS. 17, 17A and 17B are block diagrams that illustrate the computational adjustment for effecting successful copy recovery.
Figure 17A:
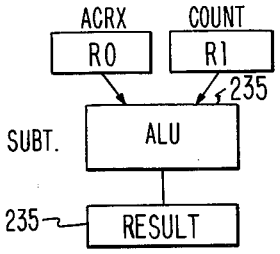
Figure 17B:
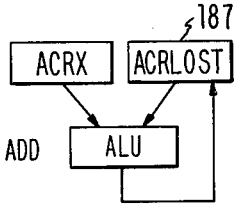

The ACRADJ program 224 procedures are explained with respect to the FIG. 17 instruction step flow chart and the two diagrammatic calculation diagrams FIGS. 17A and 17B. ACRADJ performs subtraction of an ACRX from the appropriate counter. A register R0 (in store 172 but not separately designated) contains the numerical value of ACRX, a register R1 (in the store 172, not shown) contains the counter to be corrected, while R2 (in store 172, not shown) is the link register for the branch and link operation. The remainder value is returned to the accumulator (not shown) in copy microprocessor 170 so it can be stored in the appropriate work store register 172.

At 3AB4, the actual subtraction is indicated. This is a minor procedure within ACRADJ. The functions performed at 3AB4 are set forth in FIG. 17A wherein the value of ACRX is in R0, the count to be corrected is in R1, the subtraction operation is performed in an ALU of microprocessor 170, and the result is stored in the accumulator indicated by rectangle 235.

Copy microprocessor 170 then at 3AD7 checks to see whether or not a side two flag is active, i.e., whether copy production machine 10 is in the duplex mode. If so, then the value of the ACRLOST register 187 is made equal to its present value plus the value of all ACR registers 127A. This action is indicated in FIG. 17B wherein the value of each nonzero ACR is sent to ALU for adding to the value of ACRLOST with the result returned to ACRLOST. It should be appreciated that FIG. 17B is diagrammatic and that the actual programming is straightforward for returning same to the ACRLOST register 187. The FIG. 17B action is represented by instruction step 3ADC in FIG. 17. Then at 3AFB, the answer is stored in accumulator (not shown) of copy microprocessor 170 in preparation for the above-mentioned correction of copy count register 93A.

Next, copy microprocessor 170 must illuminate the appropriate indicator 86, 87, 88 of FIG. 2 for indicating to the operator how many originals have to be reinserted through SADF 11 for successful copy recovery. This action is achieved by copy microprocessor 170 responding to the procedures illustrated in FIG. 18 BACKUPL1 225. The number of originals to be backed up has already been calculated. Therefore, at 17B6 the recopy light 86, 87 or 88 is illuminated in accordance with the value contained in backup register 188, i.e., the number of images to be copied reach the machine state when the copy sheet jam occurred. It should be recalled that not all images to be copied for recovery were actually copied. That is, SADF 11 may have ejected a non-copied original to facilitate recovery. Then copy microprocessor 170 at 17CE checks to see whether or not the value of the backup register 188 was greater than one. If so, at 17D3 various listed indicators are reset to the zero condition. Then at 17E2, the value in backup register 188 is again checked. If it is not zero, then at 17E6 backup register is set to zero and INHFD2 is set to one. INHFD2 being set indicates to copy microprocessor 170 that a run has stopped and that the SADF 11 is inhibited from entering new documents until INHFD2 is reset. This inhibit function allows the operator to put a first document to be copied in SADF tray 11A and the document in tray 11A will not be inserted onto the platen prematurely.

The copy production machine 10 is now ready for recovering the lost copies. The operator will have removed the jammed copies and restored the copy paths to their normal transport path condition. The operator then closes the misfeed reset switch 155 signaling copy microprocessor 170 to proceed from the jam condition. Copy microprocessor 170 responds to the misfeed reset switch closure to execute the misfeed reset program shown in instruction step flow chart of FIG. 19. First, the actuation of the misfeed reset button 155 is sensed in instruction steps 4212, 4221, 4229 and associated steps 42C1, 42C5, 42CA, 42CF, 42D1. Execution of these steps ensures that a positive closure of switch 155, which is a momentary switch, has occurred. This is a noise rejection feature, not important to the present invention but of interest to show the security provided by copy microprocessor 170 in sensing switch 155 actuation. The two indicators NFDRST1 and MFDRST2 are set and reset in predetermined sequences for ensuring appropriate integration of the closure of switch 155. Upon detecting that closure, the copy microprocessor 170 at 422D sets indicator MFDRST2. Then at 4231, all error conditions are reset, i.e., error flags within working store 172 are reset. These include errors caused by fuser 31, detach failure from drum 20, aligner errors at aligner 28 as well as other aligners (not shown) in copy production machine 10, exit errors, a paper on drum error, toner errors, and the like. Some nonpertinent code procedures are executed at 423A. Then at 426E, copy microprocessor 170 calls the path check program (not shown). The path check program is a scan by microprocessor 170 which scans all of the jam detection switches (not shown) in copy sheet paths 27, 29, 33 and 34, as well as the collators 14B, 14C. If all of these switches and sensors indicate the paths are clear, then recovery can proceed by starting copy production machine 10. Otherwise, the error condition is recalled and the machine 10 is inhibited from starting even though misfeed reset has been actuated.

Then at 4271, copy microprocessor checks to see whether or not the CF (maintenance) mode is active. If not, the actuation of the misfeed reset button is an indication to display the last error. At 4284 copy microprocessor 170 fetches the error from the error log (not shown) and displays it in the multidigit display (not shown) on control panel 52. Then the display is activated at 4290. Nonpertinent code procedures are executed at 4296. Then the results of the copy path (CP) check are checked at 42A6 for any CP error. If there are any, the CP indicator is set to one for illuminating light 240 of FIG. 2. Otherwise, the CPPIND is reset to zero, i.e., the machine 10 is error-free, and a restart program is called. Restart is a preparatory program for adjusting values in copy microprocessor 170 and its working store 172 to enable starting. It is not described because it is such a preliminary program. Then at 42BA, the PC advance indicator is reset to zero.

During the integration of the misfeed reset button, the CE mode condition is checked at 42D3 and if it is not a CE mode, then at 42E6 a special display is zeroed, i.e., during CE maintenance actuation of the misfeed reset button has a function related to displaying error conditions beyond the scope of the present disclosure.

Figure 20:
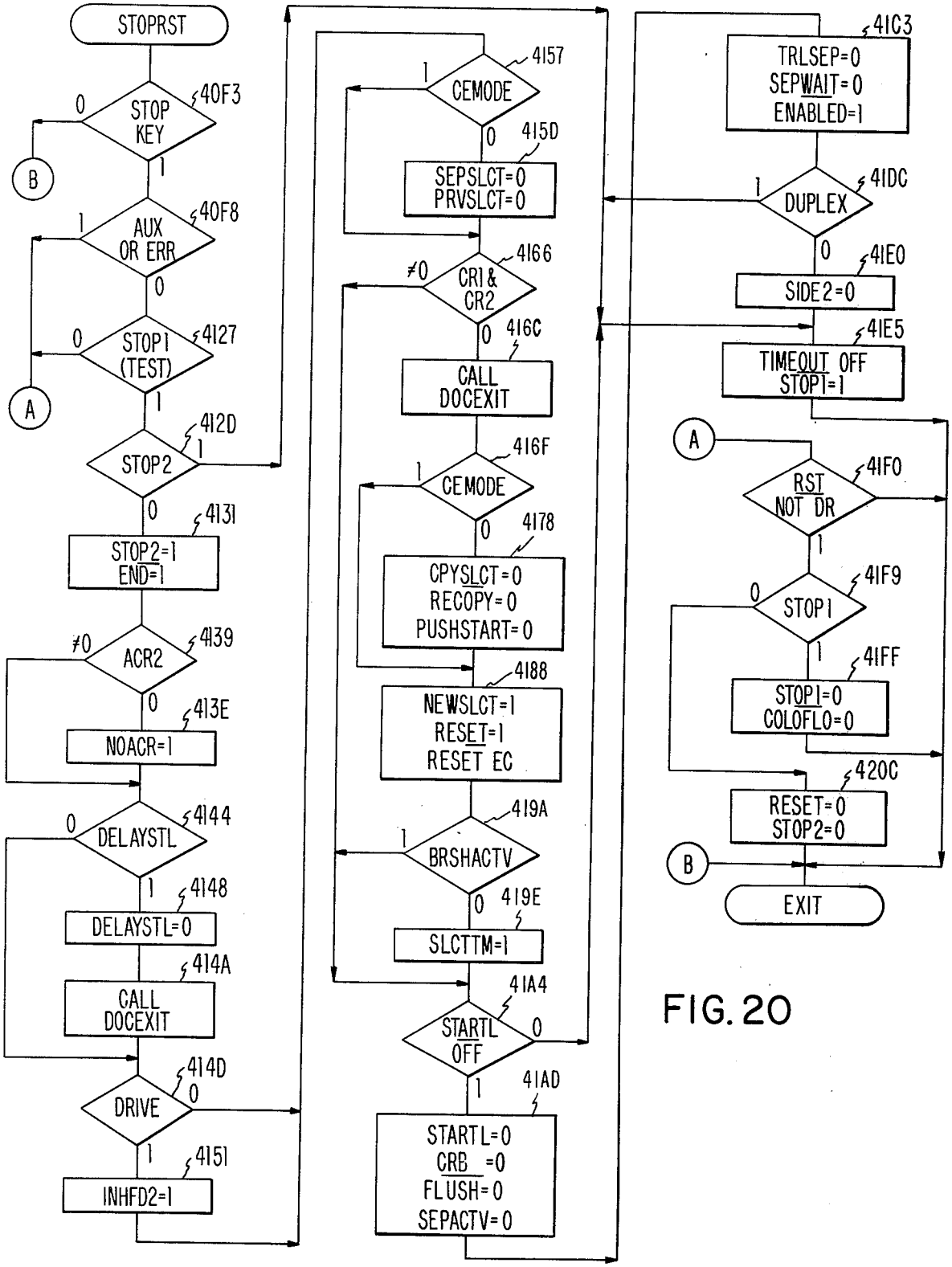
FIG. 20 is a flowchart that illustrates a stop reset procedure.

A response of control 53 to actuation of stop button 195 is shown in instruction step flow chart form in FIG. 20. Integration of the stop button is the same technique as used for integration of the misfeed reset switch 155. Two storage positions in status registers 186 are used for indicating the integration status. The first bit STOP1 and the second bit STOP2 are decoded in accordance with the following algorithmic indication. If both are zero then there has been no activity with respect to the switch being integrated. If STOP1 is active and STOP2 is zero, the switch is being integrated and is currently actuated. When both bits STOP1 and STOP2 are ones, then the switch has been actuated and is currently being held. When STOP1 is zero and STOP2 is one, the switch has been released and the control is deintegrating the actuation. The deintegration time constant can be different from the integration time constant.

Copy microprocessor 170 at 40F3 checks to see whether or not the stop key 195 was actuated by sensing STOP1 bit. If it is not actuated, then the FIG. 20 illustrated steps are omitted. If it is actuated, then at 40F8 several conditions are checked. For example, to proceed with the program steps immediately following 40F8 one of the following must occur: CE mode, PC advance, error condition either in paper paths or collator, remove copy, standby, light 232 is illuminated, or add paper. If none of those conditions are sensed (AUX means auxiliary, such as PC advance), then at 4127 STOP1 bit is sensed. If it is active, switch 195 is closed and copy microprocessor 170 then checks for the STOP2 bit at 412D. If it is a one, then integration has been completed and the copy microprocessor 170 goes to 41E5 as later described. If at the STOP1 test 4127, the bit had been set to zero, then the copy microprocessor 170 goes to 41F0.

Integration of stop switch 195 is indicated at instruction 4131 which follows the STOP1 test and the STOP2 test at 4127 and 4127D by setting STOP2 bit to one and the end bit to one. Then in connection with automatic copy recovery, copy microprocessor 170 checks the numerical contents of ACR2 at instruction 4139. If it is a zero, then ACR is inhibited at 413E by setting the NOACR bit to one. If ACR2 is nonzero, ACR has to be employed. That is, more than one image will have been lost by actuation of the stop button since copies for more than one image are currently in the copy sheet path when ACR2 is greater than zero. Actuating stop button or switch 195 can inhibit ACR or allow ACR but with no billing accommodation. That is, the correct number of copies are made (recovered) but the user is billed for copies lost due to actuation of stop button 195.

Next, at 4144 copy microprocessor 170 checks for the delay start latch, i.e., start button 165 has been actuated but for some reason the actual starting of the machine is held sending because of outstanding conditions. If the latch is a one, the delay start latch is set to reset at 4148 and the document exit subroutine is called at 414A. Accordingly, when the stop button is actuated after the start button was actuated, any delay start is erased and the document in SADF 11 is exited. If delay start had not been set, i.e., the start button 165 had not been actuated, then the last two described steps are omitted.

Actuation of the stop button requires checking the drive condition at 414D. If drive is active, then no more documents should be transported from preentry switch 122 onto the platen (not shown). Accordingly, INHFD2 is activated to the one state for inhibiting original document input to SADF 11. Then at 4157, copy microprocessor 170 again checks the CE mode. From this it can be seen that the diagnostic procedures are interleaved with the operating procedures for facilitating diagnostics based upon the actual computer program steps that effect control of the copy production machine 10. If it is not the CE mode, then at 415D copy microprocessor 170 sets the separation select and a PRV selection to zeros. These are three-byte registers (not shown) in working store 172. The separation select indicates that the number of separator sheets to be transported based upon the number of copies produced in a related copy production run, while PRV select means the number of separator sheets transported in an immediately preceeding separation operation.

For original document control, copy microprocessor 170 senses the condition of bits CR1 and CR2 of CR 210 at instruction 4166. If the two bits are zero, document exit is called at 416C. If they are nonzero, an instruction later described is entered at 41A4.

Following instruction 416C, copy microprocessor 170 at 416F again checks the CE mode. If the CE mode is not active, then the copy select register 72A, the recopy, and push start bits are set to zero. These bits are in the status registers 186 of working store 172. Then at 4188, a reset flag is set to one and a new selection is required. The EC register 201 is reset to zeroes in preparation for a restart. Also at 419A, copy microprocessor 170 determines whether or not the cleaning station 30 is being adjusted, i.e., whether the cleaning brush is being adjusted toward photoconductor drum 20. If not, selection or actuation of keyboard 71 is authorized at 419E by setting SLCTTM to one.

The microprocessor at 41A4 checks to see whether or not the start latch is set, i.e., whether the copy production machine 10 is being started or the drive off. If either of the two conditions are met, then at 41AD, start latch is reset to zero and a CRB bit in status registers 186 is zeroed. The CRB bit is a bit indicating that preparatory action is to be performed within copy production machine 10 prior to copy production in a normal startup operation. Also in 41AD, the flush, i.e., empty ISU 40 operation, and the separation mode indicators are reset. Then at 41C3, the trailing separator indicator of registers 186 is reset. A trailing separator is a separator sheet being transported to the output portion 14 upon the conclusion of a copy production run. Also, SEPWAIT bit indicating that the copy production machine 10 must wait for the separation sheets is reset. Also, within 41C3, the display (not shown) of control panel 52 is authorized (enabled=1). Then the duplex mode is checked at 41DC. If it is not duplex, i.e., ISU 40 will not be used, the side two bit of registers 186 is reset to zero at 41E0. At 41E5, a thirty-second timeout (not shown) which reselects all copy production parameters to a dominant mode is turned off because of the actuation of the stop mode. The STOP1 bit is also set to a one. The copy microprocessor 170 then exits the FIG. 20 illustrated program from 41E5.

The alternative execution path from instruction steps 40F8 and 4127 is indicated by inpage connector "A" at 41F0. If the previously mentioned reset bit is active or the drive is turned off (not DR), then the STOP1 bit is sensed at 41F9. If it is active, then STOP1 is reset at 41FF and the collector overflow control is reset; then the program is exited. If STOP1 is not active at 41F9, then at 420C the machine reset bit is set to zero and the STOP2 bit is set to zero.

It should be appreciated that the execution of the above-described stop/reset program can follow the diverse paths indicated by the multiplicity of branch instructions, the path being determined by the instant operational parameters and actuation of stop switch 195. The illustrated in FIG. 20 program will be executed several times including several times just for integrating the actuation of the switch and repeatedly for sensing the continued actuation of the switch as well as for deintegration. A separate timing program for the integration and deintegration is not shown because they follow known procedures. Those integration programs set and reset STOP1 and STOP2 in addition to the stop/reset program control of such bits.

Figure 21:
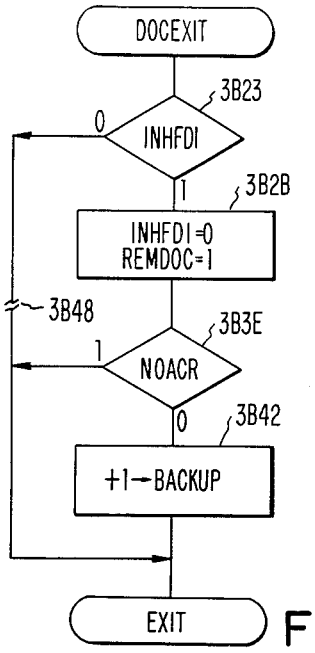
FIG. 21 is a flowchart that illustrates control of exiting a document from a document feed on the copier, particularly with relationship to copy recovery.

FIG. 21 illustrates control of the document exit of SADF 11 as it pertains to automatic copy recovery. In addition to being called by the above-described program procedures, SADF 193 also enables microprocessor 170 to call DOCEXIT 193A. FIG. 21 shows the copy microprocessor 173 sensing INHFD1 at 3B23 to determine whether or not a manual or a SADF 11 original document transport is being used. If INHFD1 is one, then the operator has manually placed an original document on the platen (not shown) in SADF 11 so that at 3B28, INHFD1 is reset to zero as a part of the ACR procedures. The remove document light 227 is illuminated by setting the REMDOC latch in status registers 168 to unity. Then at 3B3E, copy microprocessor checks the NOACR bit. If it is active, then ACR is bypassed. If it is inactive, then at 3B42 the backup register 188 numerical contents are incremented, i.e., an image has been removed from SADF 11 or from the platen (not shown). This incrementing is achieved irrespective of copies produced or not, i.e., ACR is based upon operation of SADF 11 or the manual image input. In an automatic document feed, the same procedures would be followed. Instruction steps not pertinent to the ACR are indicated in FIG. 21 by 3B48.

Figure 22:
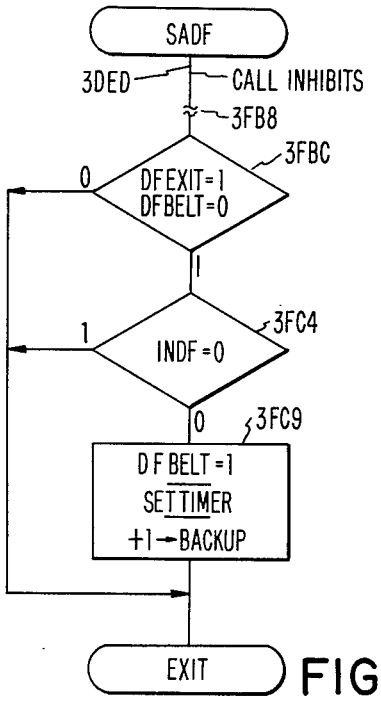
FIG. 22 is a flowchart which shows a portion of control for an automatic document feed that has pertinency to copy recovery.

SADF 193 is illustrated in abbreviated form in FIG. 22. Only those instruction steps pertinent to ACR are shown. Initially, SADF 193 calls INHIBITS program at 3DED to determine whether or not any transport of an original document is to be inhibited, such as by the INHFD2 status bit. Then nonpertinent code steps are executed at 3FB8. Finally, at 3FBC the status of a document being exited is checked, i.e., whether the exit gate (not shown, but located at exit sensing switch 82, FIGS. 1, 3, 4) of SADF 11 is open as indicated by DFEXIT=1 or whether the document transport belt (not shown) is active or not. If these conditions are met, then INDF status is checked at 3FC4. INDF means inhibit document feed 11. If INDF is active, then the program is exited. If it is inactive (INDF=0), then at 3FC9 the SADF drive belt (not shown) is activated by setting DFBELT to unity. In a separate instruction step, belt timer is activated and one is added to the numerical contents of backup register 188. That is, since the document is being exited, one more image must be copied for ACR. It should be noted that if a document were being exited as actuated by the document exit program of FIG. 21, then at 3FCBC the copy microprocessor 170 would have omitted step 3FC9. Only if a document is not being exited and the document exit belt was turned off will the instruction at 3FC9 be performed.

Figure 23:
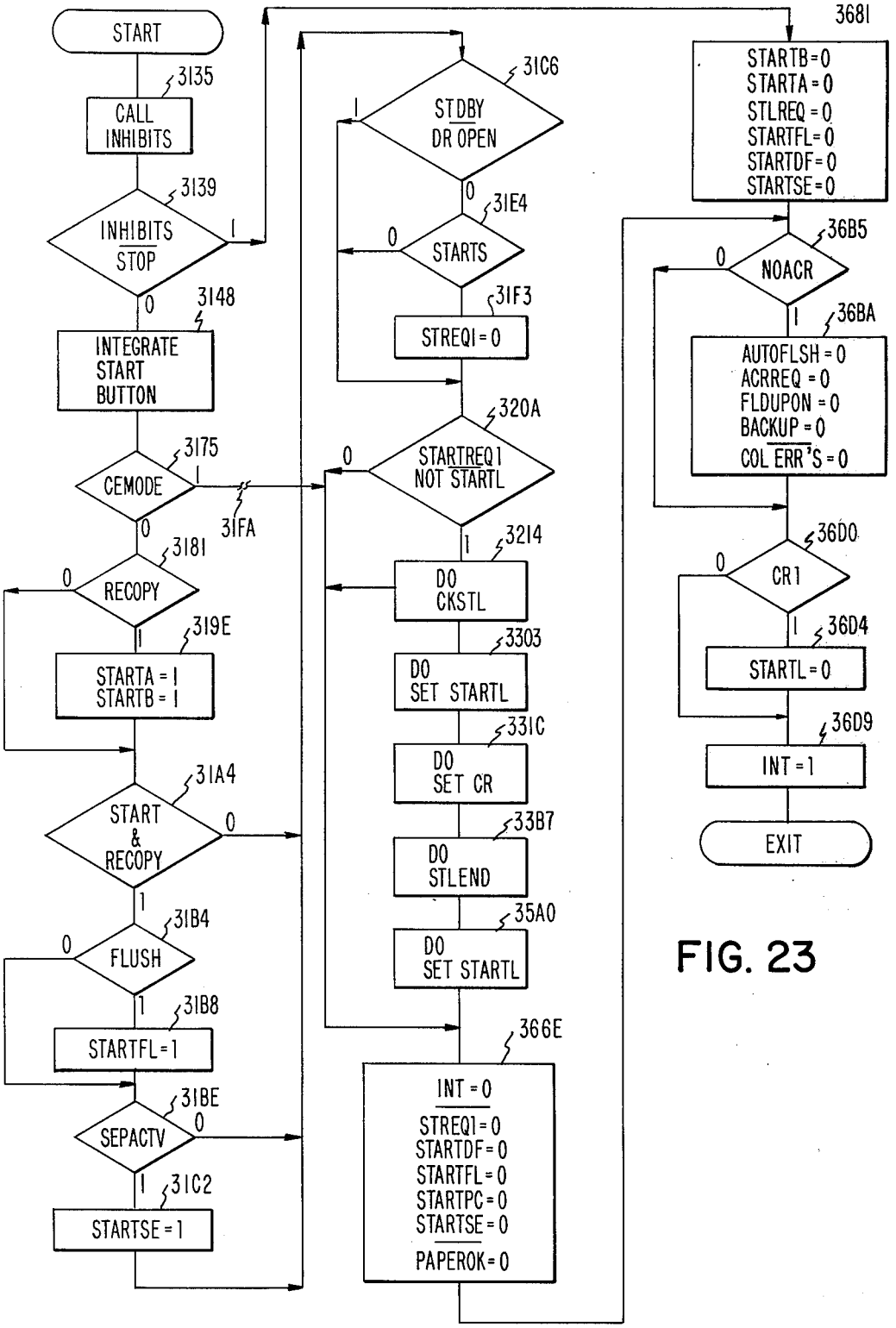
FIG. 23 is a flowchart which shows part of the start controls for a copy production machine.

In to FIG. 23, the instruction step flow chart illustrates how control 53, particularly copy microprocessor 170, responds to actuation of start button 165. These program steps are executed by copy microprocessor 170 each time idle scan 190 goes through its cycle. That is, when no other activity is occurring within coy microprocessor 170, a plurality of programs are executed by copy microprocessor 170 for determining any new action to be taken. This is done on a highly frequent basis. As seen in FIG. 23, first the copy microprocessor 170 calls the INHIBIT routine at 3135, as later described. Then at 3139, if there are any inhibits or if stop has been actuated, copy microprocessor 170 goes to 3681 for resetting all of the start flags within status registers 186. Then it checks for NOACR at 36B5. If NOACR=1, then at 36BA a plurality of flags are reset that pertain to emptying ISU 40, ACR request, backup register 188 being set to zeros, and all of the error flags relating to collators 14B, 14C are reset. Then at 36D0, the CR1 bit of CR 210 is sampled. If it is a one, then the start latch of register 186 is zeroed at 36D4. Interrupts are enabled at 36D9 for enabling the copy microprocessor 170 to respond to the EC pulses from emitter wheel 46 and the pulses from the crossover detector 213.

If there are no inhibits and if stop is not set, then from instruction step 3139, copy microprocessor 170 proceeds to integrate the stop button at 3148. This is done in the same manner as the stop button 195 is integrated. Then at 3175, the CE mode bit is tested. If it is one then some nonpertinent maintenance code is performed at 31FA with subsequent branching to other portions of the program as can be seen in FIG. 23. If the CE mode is not active, then at 3181 the recopy flag is checked to ascertain whether any of the recopy lights 86, 87, 88 are illuminated. If so, then at 319E two of the start flaps STARTA and STARTB are set to one. This action enables restarting copy production machine 10 in recovering from a jam or from lost copies due to actuation of the stop button. At 31A4, if the start latch is set and the recopy lights are illuminated, then the copy microprocessor 170 checks at 31B4 to see whether ISU 40 should be emptied. If so, a start flag (STARTFL=start flush) indicating that startup of copy production machine 10 by emptying ISU 40 is set at 31B8. Then at 31BE, the separation active flag is checked. If set, the start must include transport of separation sheets as indicated by setting the indicator STARTSE to unity. Both the emptying ISU flag and the separation flag are in registers 186.

Then at 31C6, copy microprocessor 170 checks the standby light 232 and whether there is a door (not shown) open. If so, the copy production machine 10 should not be started. If not, start indicators or latches are checked at 31E4. If none of those are active, then also there should be no start function. However, if a start is indicated, then at 31F3 a start request latch (register 186) is set. Following this function, at 320A the start request latch is sensed and the STARTL latch is sensed. If either one of those latches in registers 186 is active, then a series of subroutines are performed as indicated by 3214, 3303, 331C, 33B7 and 35A0 as will become apparent from a description of those respective subroutines. Otherwise, those subroutines are omitted.

Copy microprocessor 170 at 366E then turns interrupts off unit 36D9 for resetting all of the start latches and resets the "paper okay" latch to zero. From 366E, copy microprocessor proceeds to 36B5 where it checks for inhibition of ACR. If ACR is inhibited (NOACR=1), then at 36BA the indicator flags are reset as well as all of the collator error flags. Then at 36D0, CR1 is checked. If it is a one, then a copy sheet will be picked from either ISU 40 or one of the two copy sheet supplies 35, 35A. Accordingly, the start latch is reset to zero at 36D4 since the machine is already running and the interrupts are again honored at 36D9.

Returning to 3139, if a start is to be inhibited, then most of the above-described instruction steps are not executed. Instead, instruction step 3681 resets all of the start latches and then proceeds to the last described steps 36B5 through 36D9.

Figure 24:
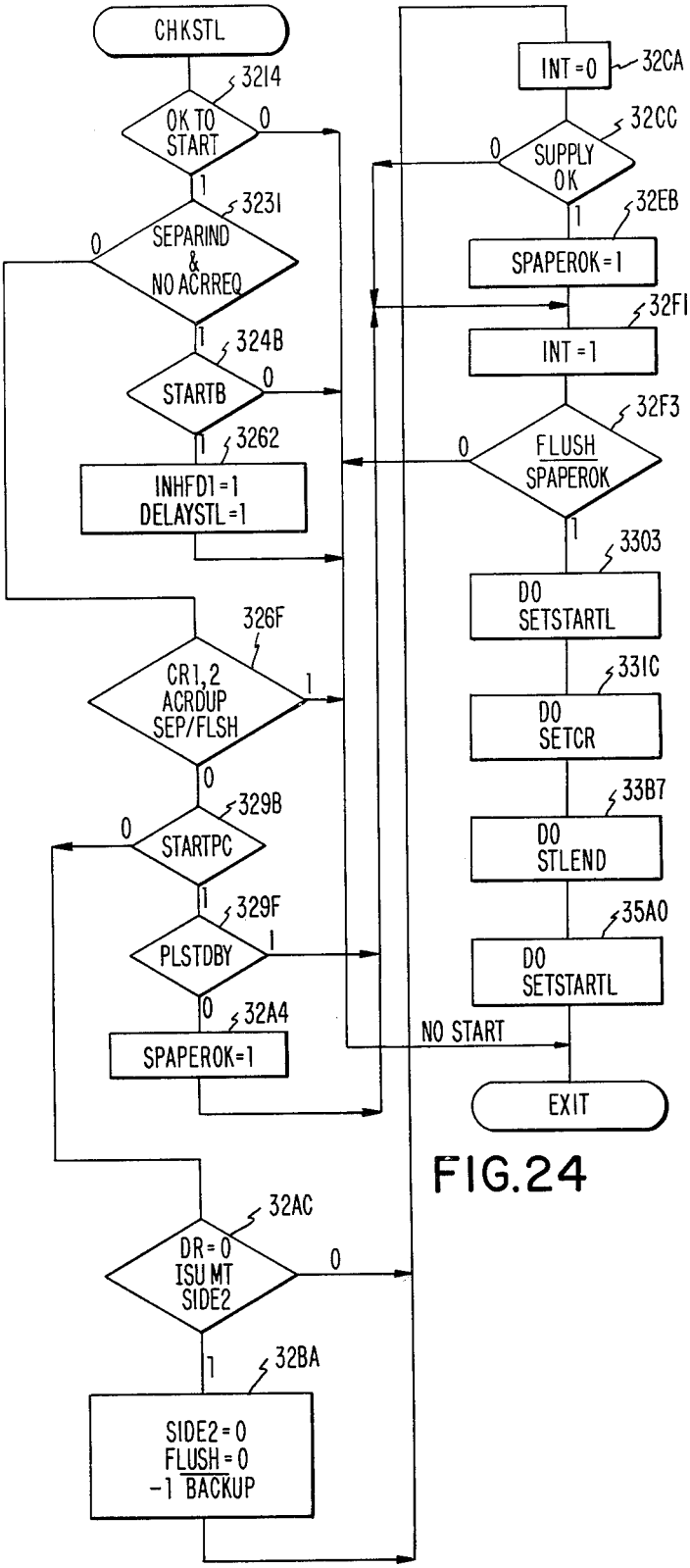
FIG. 24 is a flowchart which shows a control procedure for checking the start conditions.

FIG. 24 shows the subroutine or procedural segment CHKSTL which starts of 3214 which number also identifies CHKSTL in FIG. 23. At 3214 indications prerequisite for starting machine 10 are checked. These conditions may include all doors closed (interlock), any reduction mechanism (not shown) in optics 12 completed its automatic adjustments, and copy sheet paths clear and exit tray 14A has not filled to capacity. If these conditions are not met, starting is omitted. If met, then at 3231 the start procedure continues by further checking machine parameters, such as separation mode indication, no ACR request, not waiting for separation mode to complete, drive (motor) turned on, and no auxiliary operation (separation or flush) being started. If these conditions are not all met, the microprocessor 170 steps to 326F which is later described.

When all the 3231 conditions are met, the start button is tested for actuation at 324B. If it is not being actuated, there is no start. If actuated, then at 3262 a delay start latch in registers 186 is set and INHFD1 is set indicating a manual image input to the machine, i.e., an operator has placed a document on the SADF 11 platen (not shown) and has pushed the start button to start copying. From 3262, CHKSTL is exited by copy microprocessor 170.

On the other hand, from 3231 copy microprocessor 170 at 326F checks the status of CR1 and CR2, request for automatic copy recovery, end latch, side two values contained in registers ACR1, ACR2 (whether or not zero), and collator states including separation mode or autoflush conditions. If CR1 and CR2 are both zeros without an ACR request and the ACR registers are greater than zero and it is not an auxiliary function, then at 329B copy microprocessor 170 checks whether or not a photoconductor advance is to be performed. It so, at 329F the "please stand by" lamp 232 illumination is checked. If it is not illuminated, then paper selection is okayed enabled at 32A4. Otherwise, the step at 32F1, later described, is performed.

From 329B, if the photoconductor is not to be advanced, then at 32AC copy microprocessor 170 checks whether drive (DR) is off (main drive motor is off) and whether ISU 40 is empty (MT) with side two being active. If those conditions are met, then at 32BA the side two flag is reset, flush is set to zero, viz., since ISU 40 is already empty, there is no need to go into an empty or flush mode, and minus 1 is added to the numerical contents of backup register 188 in working store 172. With ISU 40 empty and side two active signifies that all of the copies that were residing in ISU 40 were removed; therefore, the image represented by those copies that were in ISU 40 can be decremented from the backup count in register 188.

Figure 25:
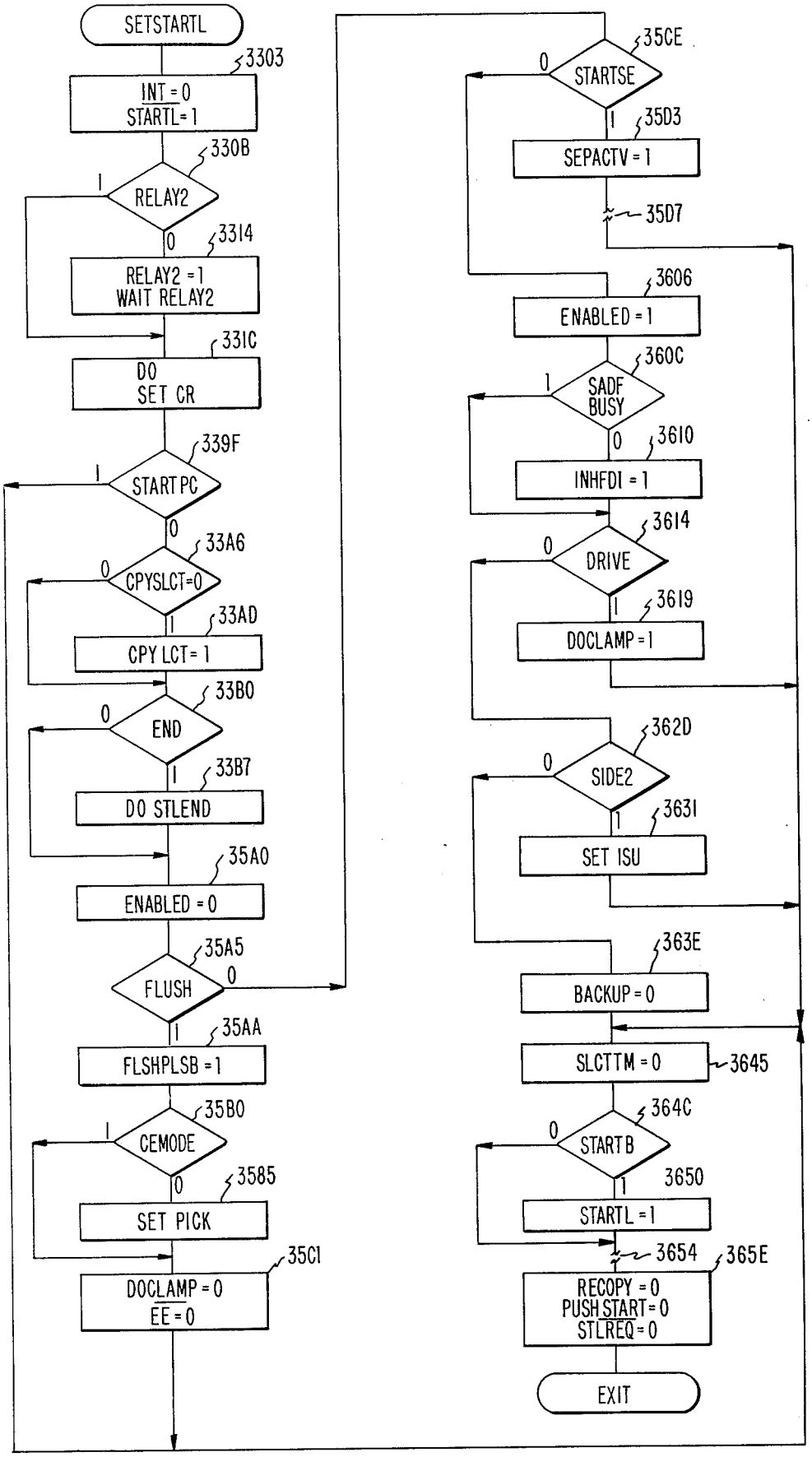
FIG. 25 is a flowchart that illustrates a control procedure for actuating a start operation.

At 32CA, interrupts to microprocessor 170 are inhibited to perform the following described operations. The copy sheet supply is checked at 32CC. For a copy operation, copy sheets have to be in supply 35 or 35A, and if it is side, two ISU 40 should have copy sheets therein. In a flush of ISU 40 is to be performed, it is immaterial whether or not paper is in ISU 40 because if it is empty, the flush will be aborted. If the paper supply is okay, a corresponding flag in registers 186 is set at 32EB. Interrupts are turned on at 32F1 and the status of ISU 40 flush and the paper okay flag are checked at 32F3. If it is not flush and the paper is not okay, then CHKSTL is exited otherwise the steps beginning with SETSTARTL 3303 are performed as next described. In FIG. 25, SETSTARTL starts with procedure step 3303 wherein the interrupts to copy microprocessor 170 are inhibited to allow the uninterrupted execution of a predetermined number of start procedure steps. Also at 3303, STARTL is set to a one condition, i.e., machine 10 is starting. At 330B, a relay 2 (not shown) which is a power-supplying relay is checked. If it is off, then at 3314 relay 2 is activated and the copy production machine 10 waits for the relay 2 to close for supplying power to fuser 31, etc. If relay 2 is already closed, no action need be taken.

At 331C, copy microprocessor 170 sets CR 210. Setting CR 210 involves several instructions not pertinent to the practice of automatic copy recovery and therefore, it is not described in detail. The sequence of instructions sets and resets various bit positions of CR 210 in accordance with operations to be performed, such as flush, separate mode, copy production and the like, as well as the present status of the machine.

At 339F, copy microprocessor 170 checks whether or not a photoconductor advance on the photoconductor drum 20 is to be performed. If so, copy microprocessor skips to instruction 3645, later described. If not, at 33A6 copy microprocessor 170 checks to see whether or not the value in the copy select register 72A of working store 172 is zero. If it is zero, it is set to unity at 33AD. The procedures of the copy production machine 10 require that at least one copy be made if a copy operation is requested by an operator. If register 72A is nonzero, of course, then no corrective action need be taken. In this regard it may be noted that during each start, SETSTARTL is repeatedly performed by copy microprocessor 170. Also, it should be noted that a timeout timer is represented by the register 190 in working store 172 of FIG. 4. Register 190 is repeatedly incremented during nonusage of machine 10 to meter a timeout period. When register 190 contains a value representing a timeout, copy select register 72A is reset to a one automatically.

The end status of copy production is checked at 33B0. The end flag of registers 186 being active means that the previous stop of the copy production machine was a normal end. That is, it was not stopped because of a copy sheet jam, fuser error, or the like. From a normal end, the STLEND procedure represented by numeral 33B7 is performed. If a normal end is not detected, then STLEND is omitted.

At 35A0, the enable flag of register 186 is reset such that the display on operator's panel 52 is disabled. At 35A5, the flush flag of registers 186 is checked. If there is no flush, a later described step at 35CE is executed. Otherwise, the "please stand by" light 232 is illuminated by another procedure not described and not pertinent to the present invention. That procedure is activated by the registers 186 flag FLUSHPLSB. At 35B0, the CE mode is checked. If machine 10 is not in a CE mode, copy sheet pick is set at 3585. If it is a CE mode, then the paper pick is omitted. At 35C1 the document lamp is turned off and edge erase is turned off. These two elements are turned off because a flush operation requires no copy transfer, and therefore, it is not necessary to scan the platen (not shown) of SADF 11 or perform edge erase. From 35C1, step 3645 is executed which is later described.

Returning to 35A5, if a flush of ISU 40 is not to be performed, then the separation start is checked at the 35CE. If it is a separation mode start, then the separate active flag is set to the active condition at 35D3 and nonpertinent separate mode procedures are performed as indicted by 35D7. From here step 3645, later described, is performed.

If the separation mode is not to be performed as indicated by a zero at 35CE, the display is reenabled at 3606. Whether or not SADF 11 is busy is checked at 360C. If it is not busy, then a manual operation is indicated by 3610 by setting INHFD1 to one. Otherwise, at 3614 the condition of the drive motor (not shown) which drives all of the mechanical apparatus within copy production machine 10 is checked. If it is active, then the document lamp is indicated to be turned on at 3619. Then step 3645 is executed which is later described. If drive is off, then the side two flag of registers 186 is checked at 362D. If it is active, then ISU 40 is set as a source of copy sheets at 3631. If not, backup register 188 is set to zero at 363E. At this point in time, the machine is ready to start.

The instruction at 3645 disabled keyboard 71 from making further selections. The start button is checked at 364C. If the start button has been honored, then STARTL flag is set to one at 3650. Nonpertinent code steps relating to starting are also performed at 3654. At 365E the recopy lights 86, 87, 88 of FIG. 2 are extinguished, a push start which is an automatic start flag of registers 186 is reset, and a start latch request flag in registers 186 is also reset.

Figure 26:
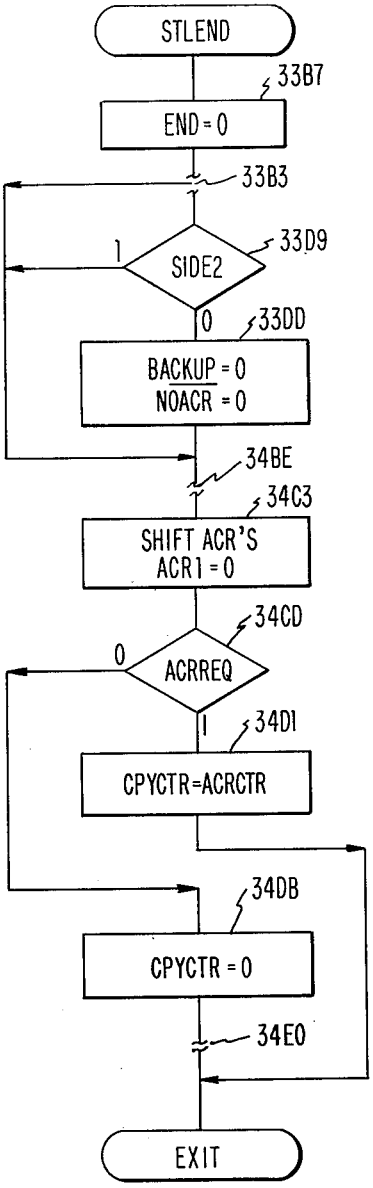
FIG. 26 is a flowchart which illustrates a portion of a start-up procedure used after a normal ending of a previous copy production operation.

FIG. 26 illustrates the pertinent portion of STLEND. At 33B7, copy microprocessor 170 resets the end flag of registers 186; then some nonpertinent code steps are executed at 33BE. Finally, at 33D9 side two is again checked. If it is not side two, then backup register 188 is reset to all zeros and NOACR is reset. Subsequent copy production is subject to ACR. Then, more nonpertinent code steps are executed at 34BE. Then, at 34C3 the numerical contents of the ACR registers 127A are shifted to more significant register positions. That is, assuming that ACR1 through ACR3 are the ones that are pertinent to the constructed embodiment, then ACR3 must be all zeros. The numerical contents of ACR2 are shifted to ACR3, the numerical contents of ACR1 are shifted to ACR2, leaving ACR1 all zeros. This type of operation is well known and is not described in detail for that reason. At 34CD, the ACR request flag is checked. If an ACR request is active, on then by the step at 34D1 the copy counter register 93A is made equal to the ACR counter register 230. This means that upon completion of the ACR recovery functions, the previous copy count stored in ACR counter register 230 is restored to copy counter register 93A. If ACR request is not active, then the copy counter register 93A is zeroed at 34DB, followed by nonpertinent steps 34E0.

Figure 27:
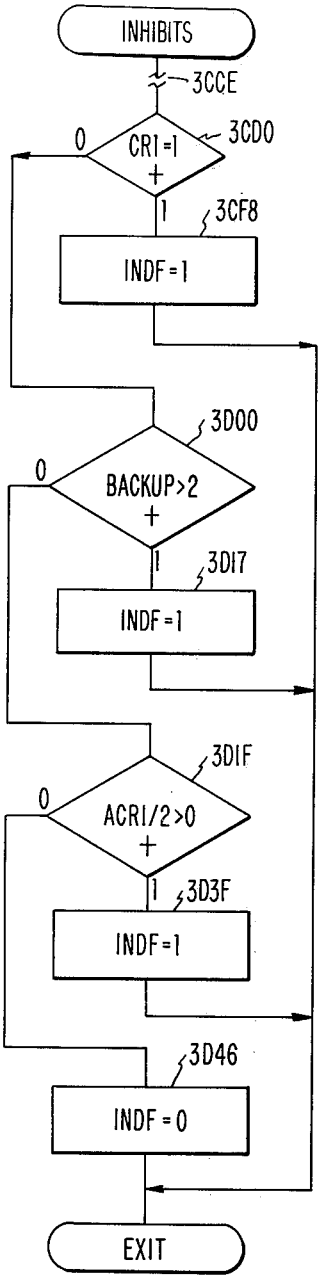
FIG. 27 is a flowchart that illustrates a portion of an inhibiting control for preventing start and which pertains to copy recovery.

FIG. 27 shows the inhibits procedures that pertain to ACR as referred to in FIG. 22, for example. Copy microprocessor 170, of course, has to check many functions not pertinent to ACR with respect to operation of SADF 11. This action is indicated at 3CCE. At 3CD0, the main point is to check the content of CR1 of CR 210. If the CR1 bit is a one, this means that a sheet has been picked from one of the sheet supplies 40, 35 or 34A. At that point in time, INDF is set to one at 3CF8 for inhibiting further operation of the SADF 11 during copy production. If CR1 is not a one, then at 3D00 the numerical contents of backup register 188 are checked. If the value in backup register 188 is greater than two, i.e., more than two images are in the copy paths of machine 10, then at 3D17 SADF 11 is set to be inhibited. If not, the values of ACR1 and ACR2 are checked at 3D1F. If either one is greater than zero, then at 3D3F SADF 11 is inhibited. If none of the above conditions are met, then SADF 11 can be operated as indicated by resetting the inhibit flag of registers 186 at 3D45.

Figure 28:
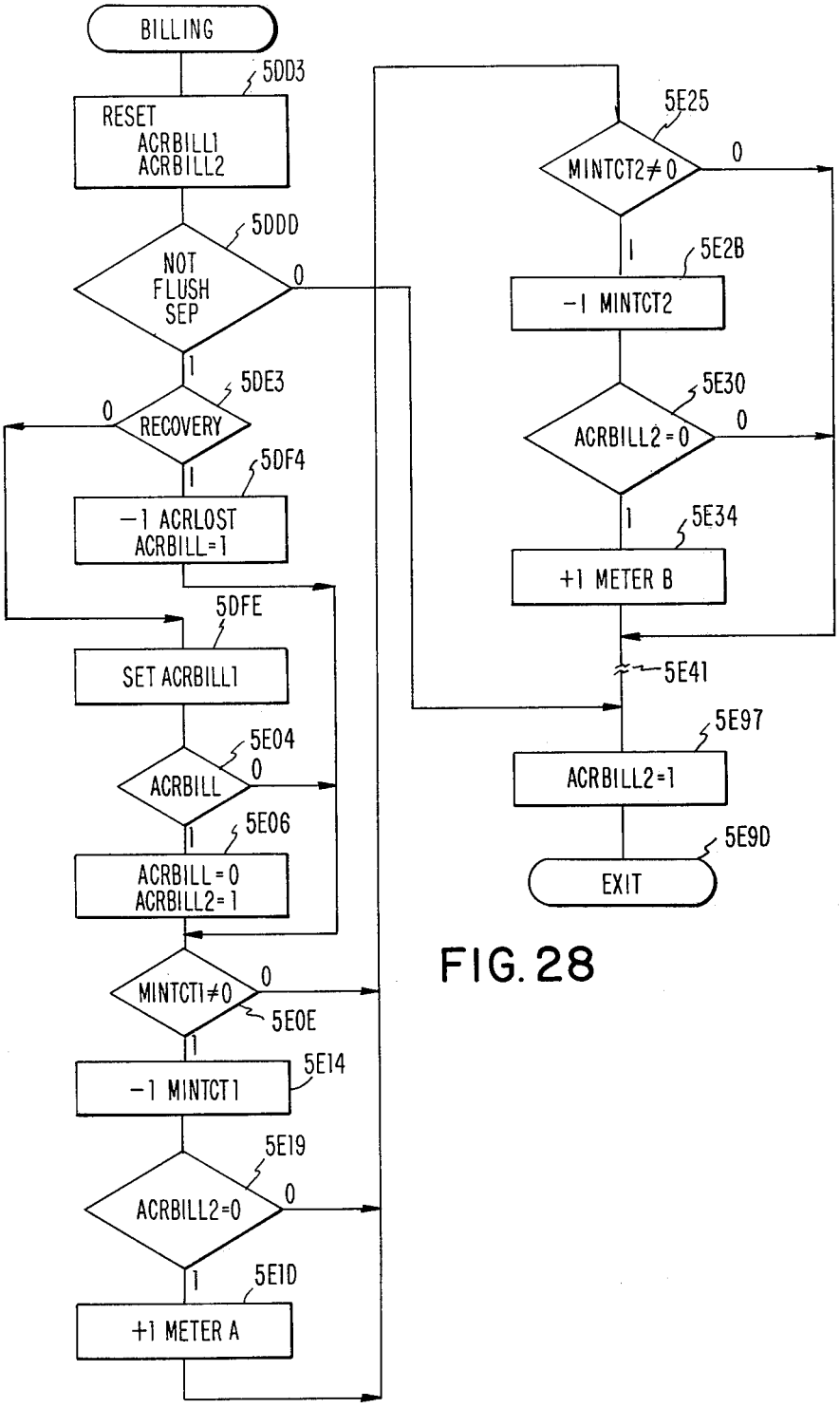
FIG. 28 is a flowchart that shows a control for billing in connection with copy recovery.

FIG. 28 illustrates procedures for actuating billing meter M as such procedures pertain to ACR. Three indicators are of interest in understanding the operation of the billing procedure. The first flag, ACRBILL, when one indicates that billing was active at the time hard stop program was called. That is, a copy sheet jam could occur during a copy exit operation. Also, in the flush or separation mode, it would also result in ACRBILL being zero. A second flag ACRBILL1 inhibits billing. That is, the billing meter M is not actuated. This means that the copies being supplied to output portion 14 are those being substituted for the copies lost during the copy sheet jam. ACRBILL2 is set to the active condition when the copy sheet being exited from copy production machine 10 is under the exit switch 105, 110 or 102 which is designated as the billing meter switch. That is, in the noncollate mode, the copies go to exit tray 14A and switch 102 is the billing meter switch. At other times, switches 105 and 110 of collators 14B, 14C are the billing meters depending on the count involved in copies during the collate mode. When images are billed, then switch 113 of ISU 40 is the billing meter of the side one portion of the duplex copy production mode.

In executing the billing procedures, copy microprocessor 170 at 5DD3 resets the two flags, ACRBILL1 and ACRBILL2. At 5DDD, auxiliary operations are checked. In the illustrated embodiments these auxiliary operations are emptying or flushing ISU 40 or the separation mode. Then billing is not to be performed. Then copy microprocessor 170 immediately goes to 5E97 where ACRBILL2 is set to unity. The billing procedure illustrated in FIG. 28 is invoked whenever one of the above-described switches 102, 105, 110 is activated and has been selected as the billing exit switch. Accordingly, it is known at that time whether or not a copy sheet is still under the designated billing switch.

On the other hand, if it is an auxiliary operation, as indicated by the branch at 5DDD, then whether or not an ACR (recovery) is being performed is checked at 5DE3. If so, at 5DF4 minus one is added to the numerical contents of ACRLOST register 187 and ACRBILL2 is set to one. If it is not a recovery, then at 5DFE ACRBILL1 is set to one. Then at 5E04, ACRBILL is checked. If it is one, ACRBILL is reset at 5E06 and ACRBILL2 is set to one. Then at 5E0E, 5E14, 5E19, 5E1D through 5E34, data meters are incremented not pertinent to the operation of ACR. Billing meter M is incremented in the indicated nonpertinent steps 5E41 only if ACRBILL2 is zero. In the duplex mode, a duplex billing meter (not shown) is also incremented whenever ACRBILL2 is zero.

With respect to the indicators, flags, or bits of registers 186, none of these are separately shown, it being understood that each is a bit position of registers 186. Such bit positions are accessed as any bit position of a computer or processor memory is accessed.

The described automatic copy recovery makes it possible for the operator to recover from all copy sheet misfeeds (jams) with a minimum effort. A key part of this recovery is the communication to the operator via the operator's control panel 52.

The following examples illustrate the communication to the operator and the operator's intervention in three different copy run modes when a misfeed (jam) occurs:

1. SIMPLEX MODE OF COPY PRODUCTION

CPPIND 240 is activated and if in copy overlap mode (copies of more than one image are in the copy sheet path), then SADF 11, if used initially, may exit the document on the glass and inhibits feeding the next document. The document in SADF 11 is exited if it is not the first document to be recopied for recovery.

The copy display (not shown) indicates the number of good copies in the exit pocket 14A or collator 14B, 14C.

The operator clears the copy sheet jam and depresses the misfeed reset push button 155.

If any documents need to be recopied, one of the following indicators is activated:
Recopy Last Document 86
Recopy Last 2 Documents 87
Recopy Last 3 Documents 88.

The operator depresses the start push button 165 if depress start button indicator (not shown) is active.

If one of the recopy indicators is active, the operator reinserts the appropriate document(s) to be recopied.

The machine continues delivering the initially selected number of copies.

At the end of the copy sheet jam interrupted copy run, the display (not shown) indicates the number of good copies in the exit pocket 14A or collator 14B, 14C which is the number originally selected.

2. RECOVERY WHEN A DUPLEX SIDE 1 COPY PRODUCTION IS INTERRUPTED BY A COPY SHEET JAM

CPPIND 240 is activated. If machine 10 is in copy overlap mode and the SADF 11 was used initially, SADF 11 may exit the document on the glass and will inhibit feeding in the next document. If there are any copies in ISU 40, the light 241 is illuminated and the display (not shown) indicates the number of copies in ISU 40 (duplex tray). The operator clears the copy sheet jam and depresses the misfeed reset push button 155.

If any documents need to be recopied, the applicable recopy indicator 86, 87, 88 is activated. The operator depresses the start push button 165 if depress start button indicator (not shown) is active.

If SADF 11 did not exit a document, the document on the SADF 11 platen is to be recopied requiring the operator only to push the start button 165. If one of the recopy indicators is active, the operator reinserts the appropriate document(s) to be recopied. The machine continues delivering the selected number of copies. At the end of the duplex side 1 copy run, the display indicates the number of good side 1 copies in the duplex tray 40 which is the number originally selected. The machine is now ready to produce side 2 of the duplex copies to be produced.

3. RECOVERY FROM A COPY SHEET JAM INTERRUPTED DUPLEX SIDE 2 COPY PRODUCTION

Lamp CPPIND 240 is activated. If the copy overlap mode and SADF 11 were used initially, SADF 11 may exit the document on the glass and inhibits feeding in the next document. Upon recovery, side 2's are finished first based on copies in ISU 40, then completely new copies are made for sheets lost bearing a side 1 image.

Lamp 241 is activated if there are any copies in the duplex tray 40. The copy count display (not shown) indicates the number of good copies in the exit pocket 14A or collator 14B, 14C.

The operator clears the copy sheet jam and depresses the misfeed reset push button 155.

If any documents need to be recopied, the applicable recopy indicator is activated.

The operator depresses the start push button if depress start button indicator is active. If one of the recopy indicators is active, the operator reinserts the document(s) to be recopied.

The machine continues to deliver all copies remaining in the duplex tray 40. Then the SADF, if used initially, exits the side 2 document and inhibits feeding the next document.

The applicable recopy indicator is activated which indicates the number of documents (two) to be recopied. The operator reinserts the side 1 document. The number of side 1 images for recovery are then produced followed by the same number of side 2 images. The side 1 operation is completed to make the lost copies, and ACRLOST is decremented by one instead of activating COPYCTR at the time COPYCTR would have been normally incremented. If the operator manually removes any or all of the copies in the duplex tray 40, the copy counter value will not equal the copy select register value when the side 2 copy run is completed. If ACRLOST is equal to zero, then no additional unfitted side 1 copies are to be made and the recovery indicators are not activated. If ACRLOST is greater than zero, the applicable recovery indicator is activated and the quantity of unbilled side 1 copies allowed to be made will not exceed the value in ACRLOST. This procedure inhibits billing for any lost copies during recovery.

While the invention has been particularly shown and described with references to preferred embodiments thereof, it will be understood by those skilled in the art that various changes in form and details may be made therein without departing from the spirit and scope of the invention.

What is claimed is:

1. The method of operating a copy production machine for identifying images copied onto copy sheets said machine having a copy production portion, an output portion, and copy sheet path means extending through said copy production portion to said output portion, a plurality of image bearing copy sheets being simultaneously transportable serially through said path means, said sheets carrying diverse images, comprising the steps of:

establishing a plurality of separate counts of copy sheets respectively for each of said images on said copy sheets currently being transported in said path means, subtracting one from a respective one of said separate counts as a given sheet bearing an image reaches a predetermined point in said path means with respect to said output portion, and adding one to a given one of said counts to indicate that said copy production portion will produce a given one of said images on a copy sheet.

2. The method of claim 1, further including the steps of:

maintaining a running account of copies produced, detecting a copy sheet path means malfunction, and adjusting said running account in accordance with the total of all said separate counts.

3. The method of claim 2, further including the step of indicating which of said counts indicate the images that have to be reproduced to complete a copy job for omitting none of said images being copied.

4. The method of claim 2 further including the step of:

transferring said separate counts to a given register as a total of all said separate counts and stopping said machine in response to a detected copy sheet path means malfunction, restarting the copy production machine, and adjusting said running account by the steps of decrementing said total of all said separate counts in said given register for each copy produced, and inhibiting adjusting said running account until said decremented total count becomes zero.

5. The method of claim 1 further including maintaining a tally of the number of different images on copies currently in said paper path means, and upon a misfeed indicating said tallied number as a number of original images to be reproduced for copy recovery.

6. The method of claim 5 further including the steps of:

reproducing previously produced images up to said respective separate counts and, upon reaching each said respective separate counts, indicating a number of images to be reproduced as the immediately preceding number less one of images to be reproduced until the number of images to be reproduced is zero, and resuming copy production with subsequent images to be produced.

7. The method of claim 5 wherein said machine has input means for supplying a succession of images for copy production, further including the steps of:

indicating a maximum number of images to be permitted on copy sheets in said paper path at a given time, and inhibiting said input means from supplying a new image for copy production whenever said number of different images equals said maximum number.

8. The method set forth in claim 1 further including the steps of:

establishing a first of said separate counts upon initiation of copy production, with a first image, upon beginning copy production with a second image making said first count as a second count and restarting another first count for said second image, and as copy sheets bearing said first image reach said output portion decrementing said second count.

9. The method set forth in claim 1 for tracking three images at one time in said copy path including the steps of:

counting copies of a first image as a first first count, beginnning copy production of a second image, making said first first count a first second count and counting copies of said second image as a second first count, beginning copy production of a third image, making said first second count a first third count, making said second first count a second second count and counting copies of said third image as a third first count, and decrementing said counts as each copy reaches said output portion beginning with said first third count until said first third count is zero, then decrementing said second second count until said second second count is zero and then decrementing said third first count until said third first count is zero.

10. The method set forth in claim 1 further including the steps of:

counting each new image for copy production as an image backup count, each time any one of said separate counts goes to zero, decrement said image backup count whereby said image backup count is a maintained count of images currently in said copy path and each respective separate count signifies the number of copies of such images currently in said copy path.

11. A cyclically operable machine for processing a series of articles, including means for grouping said articles into groups according to preselected characteristics and transport means having the capability for handling a plurality of groups within said machine at a given instant, comprising, in combination:

means for detecting articles entering and leaving said transport means, means responsive to said grouping means for supplying a count value representative of the number of articles within each group;

a plurality of storage means, one corresponding to each group, coupled to said count value supply means for storing the count value of corresponding groups; and means responsive to said detecting means for altering said corresponding stored count values as articles of said groups are detected entering and leaving said transport means.

12. The method of recovering from a copy sheet misfeed in a copy production machine having a copy sheet transport path capable of handling at one time a plurality of groups of copy sheets, each group of copy sheets bearing images from sources different from the sources of the other groups, comprising the steps of:

indicating the number of copy sheets to be reproduced from each source;

maintaining a plurality of separate counts of the number of copy sheets in each group in the transport path, each of said separate counts corresponding to each of said groups, including the step of modifying the separate counts as copy sheets corresponding to the groups enter and leave said transport path;

detecting a misfeed;

recopying from corresponding sources the number of copy sheets specified by the separate counts in each corresponding group when said misfeed was detected; and adjusting said indicated number according to corresponding said separate counts when said misfeed was detected.

13. The method of controlling a copy production machine having a copy transport path means with a plurality of stations disposed along the path means and said copy transport path means being capable of simultaneously containing copy sheets produced from different image sources, comprising the steps of:

indicating relative locations of copies along said copy path means, tallying separately the number of copies in said path means produced from each image source including the step of indicating relative locations of such copy sheets with respect to copy sheets produced from other image sources independently from actual location thereof in said path means, and combining said indications to operate said copy production machine in accordance with said separate tallies whereby said machine identifies the copy sheets in said path means corresponding to each image source to enable diverse operations peculiar to each plurality of copy sheets produced from the same image source.

14. The method of operating a copy production machine for identifying images and copying images onto copy sheets, said machine having a copy production portion, an output portion, and copy sheet path means extending through said copy production portion of said output portion, said path means being capable of serially transporting at one time a plurality of groups of copy sheets each group corresponding to a different image, comprising the steps of:

establishing a plurality of separate counts of copy sheets respectively for each of said groups of said copy sheets in said path means, subtracting one from a corresponding one of said separate counts as a copy sheet of that group reaches a predetermined point in said path means with respect to said output portion, and adding one to a corresponding one of said separate counts to indicate that said copy production portion is to produce a copy sheet of that corresponding image.

15. The method of claim 14, further including the steps of:

maintaining a running account of copies produced, detecting a copy sheet path means malfunction, and adjusting said running account in accordance with the total of all said separate counts.

16. The method of claim 15, further including the step of indicating which of said separate counts indicates the image will to be reproduced to complete a copy job for omitting none of said images that being copied.

17. The method of claim 15 further including the steps of:

stopping said machine upon detection of a copy sheet path means malfunction, and transffering said separate counts to a given register as a total of all said separate counts, restarting the copy production machine, and adjusting said running account by the steps of decrementing said total of all said separate counts in said given register for each copy produced, and inhibiting adjusting said running account until said decremented total count becomes zero.

18. The method of claim 14 further including maintaining a tally of the number of groups currently in said copy sheet path means, and indicating said tallied number as a number of original images to be reproduced for copy recovery after a copy sheet path means malfunction occurs.

19. The method of claim 18 further including the steps of:

reproducing previously produced copy sheets up to the said respective separate counts and, upon reaching each said respective separate counts, indicating a number of copy sheets to be reproduced as the immediately preceding number less one of images to be reproduced until the number of images to be reproduced is zero, and resuming copy production with subsequent images to be produced.

20. The method of claim 18 wherein said machine has input means for supplying a succession of images for copy production, further including the steps of:

indicating a maximum number of groups to be permitted on copy sheets in said paper path at a given time, and inhibiting said input means from supplying a new image for copy production whenever said number of groups equals said maximum number.

21. The method set forth in claim 14 further including the steps of:

establishing a first of said separate counts upon initiation of copy production, with a first image, making said first count a second count upon beginning copy production with a second image, restarting another first count for said second image, and decrementing said second count as copy sheets bearing said first image reach said output portion.

22. The method set forth in claim 14 for tracking three group at one time in said copy path including the steps of:

counting copies of a first image as a first first count, upon beginning copy production of a second image, making said first first count a first second count and counting copies of said second image as a second first count, upon beginning copy production of a third image, making said first second count a first third count, making said second first count a second second count, and counting copies of said third image as a third first count, and decrementing said counts as each copy reaches said output portion beginning with said first third count until said first third count is zero, then decrementing said second second count until said second second count is zero and then decrementing said third first count until said third count is zero.

23. The method set forth in claim 14 further including the steps of:

counting each group for copy production as a backup count, and each time any one of said separate counts goes to zero, decrementing said backup count whereby said backup count is maintained as a count of groups currently in said copy path and each respective separate count signifies the number of copy sheets within groups currently in said copy path.

* * * * *